US011771158B2

(12) United States Patent
Lotti

(10) Patent No.: US 11,771,158 B2
(45) Date of Patent: Oct. 3, 2023

(54) APPLICATORS FOR APPLYING EYELASH EXTENSIONS AND METHODS FOR USE AND MANUFACTURE THEREOF

(71) Applicant: Lashify, Inc., Los Angeles, CA (US)

(72) Inventor: Sahara Lotti, Los Angeles, CA (US)

(73) Assignee: Lashify, Inc., North Hollywood, CA (US)

( * ) Notice: Subject to any disclaimer, the term of this patent is extended or adjusted under 35 U.S.C. 154(b) by 0 days.

(21) Appl. No.: 16/810,787

(22) Filed: Mar. 5, 2020

(65) Prior Publication Data

US 2020/0196694 A1 Jun. 25, 2020

Related U.S. Application Data

(63) Continuation of application No. PCT/US2019/057102, filed on Oct. 19, 2019.

(60) Provisional application No. 62/748,335, filed on Oct. 19, 2018.

(51) Int. Cl.

| | |
|---|---|
| ***A41G 5/02*** | (2006.01) |
| ***A45C 11/00*** | (2006.01) |
| *B65D 85/00* | (2006.01) |

(52) U.S. Cl.

CPC ..... *A41G 5/02* (2013.01); *A45C 11/008* (2013.01); *B65D 85/00* (2013.01)

(58) Field of Classification Search

CPC . A41G 5/02; A41G 5/04; A41G 5/004; A41G 5/006; A45D 2200/10; A45D 2/48; A45D 44/00; A45D 26/0066

USPC ..... 132/200, 201, 53, 216, 320, 330, 333, 132/217; D28/7, 36, 55

See application file for complete search history.

(56) References Cited

U.S. PATENT DOCUMENTS

| | | | | |
|---|---|---|---|---|
| 232,595 | A * | 9/1880 | Hanisch | B02C 13/26 241/55 |
| 1,021,063 | A | 3/1912 | Miller | |
| 1,450,259 | A | 4/1923 | Charles et al. | |
| 1,657,497 | A | 1/1928 | Cichon | |

(Continued)

FOREIGN PATENT DOCUMENTS

| | | |
|---|---|---|
| CN | 303086463 | 10/2009 |
| CN | 302315323 | 2/2013 |

(Continued)

OTHER PUBLICATIONS

MAC Lash Applicator, 2014, https://www.maccosmetics.com/product/13811/32724/products/brushes-tools/tools/sponges-applicators/lash-applicator?gclid=EAIaIQobChMIsqzhnIz79AIVHAaICR0qngPWEAQYAyABEgKxP_D_BwE&gclsrc=aw.ds (Year: 2014).*

(Continued)

*Primary Examiner* — Jacqueline T Johanas
*Assistant Examiner* — Sarah Woodhouse
(74) *Attorney, Agent, or Firm* — Lowenstein Sandler LLP

(57) ABSTRACT

An applicator comprising: a first arm having a first grasping tip that is arcuate, wherein the first grasping tip has a first inner side hosting a male portion; and a second arm having a second grasping tip that is arcuate, wherein the second grasping tip has a second inner side hosting a female portion, wherein the first inner side faces the second inner side, wherein the male portion and the female portion avoid mating when the first arm and the second arm are at a default position, wherein the male portion and the female portion mate when the first arm and the second arm are at a grasping position.

16 Claims, 13 Drawing Sheets

(56) References Cited

U.S. PATENT DOCUMENTS 1,831,801 A 11/1931 Birk
1,897,747 A 2/1933 Birk
1,920,401 A 8/1933 Kahn
2,013,011 A 9/1935 Sheldon
D101,791 S 11/1936 Rauh
D129,526 S 9/1941 Hanisch
2,268,082 A 12/1941 Phillips, Sr.
2,323,595 A * 7/1943 Hanisch ..... A45D 2/48 132/317
2,392,694 A * 1/1946 Rector ..... A45D 2/48 132/217
D154,227 S 6/1949 Alvizua
D155,559 S 10/1949 Tillmann
2,618,279 A 11/1952 Reiffert
2,812,768 A 11/1957 Giuliano
3,016,059 A 1/1962 Hutton
3,032,042 A 5/1962 Borg
3,245,416 A 4/1966 Victor
3,295,534 A 1/1967 Dorkin
3,343,552 A 9/1967 Steffen
3,392,727 A * 7/1968 Hanlon ..... A61B 17/30 606/210
3,447,540 A 6/1969 Osher
3,454,015 A 7/1969 Udes
3,478,754 A 11/1969 Martin, Jr.
3,547,135 A 12/1970 Roos
3,557,653 A 1/1971 Kim
3,561,454 A 2/1971 O'connell
3,625,229 A * 12/1971 Silson ..... A41G 5/02 132/216
3,645,281 A 2/1972 Seidler
3,670,742 A * 6/1972 Weaner ..... A41G 5/02 132/216
3,703,180 A 11/1972 Aylott
3,818,784 A 6/1974 McClure
3,828,803 A * 8/1974 Windsor ..... A45D 44/00 132/216
3,833,007 A 9/1974 Jacobs
3,900,038 A 8/1975 Masters
D240,769 S 7/1976 Bowman
3,968,807 A 7/1976 Kraicer
3,970,092 A 7/1976 Nelson
3,970,992 A 7/1976 Boothroyd et al.
3,971,392 A 7/1976 Brehmer
3,980,092 A 9/1976 Garufi
3,982,313 A 9/1976 Nelson, Jr.
4,016,889 A 4/1977 Cowles
4,029,111 A 6/1977 Barton
4,049,006 A 9/1977 Saunders et al.
4,168,713 A 9/1979 Agiotis
4,203,518 A 5/1980 Current
4,205,693 A 6/1980 Mallouf
4,225,693 A 9/1980 McCormick
4,254,772 A 3/1981 McNamee
4,254,784 A 3/1981 Nelson
4,284,092 A 8/1981 Auretta
4,296,765 A 10/1981 Bachtell
D261,601 S 11/1981 Kettlestrings
4,299,242 A 11/1981 Choe
4,360,033 A 11/1982 Schmehling
4,395,824 A 8/1983 Puro
4,458,701 A * 7/1984 Holland ..... A45D 40/265 132/218
4,509,539 A 4/1985 Alfieri
D280,354 S 8/1985 Bakic
D281,825 S 12/1985 Bakic
4,600,029 A 7/1986 Ueberschaar
4,697,856 A 10/1987 Abraham
4,739,777 A 4/1988 Nelson
4,761,028 A 8/1988 Dulebohn
D298,070 S 10/1988 Ferrari
4,784,713 A 11/1988 Van Nieulande
D299,561 S 1/1989 Bakic
D301,371 S * 5/1989 Kaprelian ..... D24/143
D302,602 S 8/1989 Bakic
4,865,057 A 9/1989 Braun
4,934,387 A 6/1990 Megna
4,964,428 A 10/1990 Lamatrice
D314,066 S 1/1991 Bakic
5,003,467 A 3/1991 Donaldson et al.
5,010,914 A 4/1991 Merges
D318,346 S 7/1991 Bakic
5,033,626 A 7/1991 Platti
5,072,745 A 12/1991 Cheh
5,082,010 A 1/1992 Skaryd et al.
5,117,846 A 6/1992 Finamore et al.
D328,246 S 7/1992 Nottingham et al.
5,154,195 A 10/1992 Irisawa
D342,671 S 12/1993 Elliott
5,307,826 A * 5/1994 Iosilevich ..... A45D 40/262 132/218
5,322,166 A 6/1994 Crowther
5,368,052 A 11/1994 Finamore
5,377,700 A 1/1995 Harris
D358,312 S 5/1995 Keenan
D358,908 S 5/1995 Rawski
5,411,775 A 5/1995 Wilson
5,419,345 A 5/1995 Kadymir
D359,583 S 6/1995 Abbo
5,533,529 A 7/1996 Ohno
5,547,529 A 8/1996 Woolf
5,571,543 A 11/1996 Song et al.
D379,923 S 6/1997 De Baschmakoff
D380,616 S 7/1997 Leslie et al.
D382,198 S 8/1997 Mulhauser et al.
D386,808 S 11/1997 Litton
D387,483 S 12/1997 Sloan
D388,549 S 12/1997 Mouyiaris et al.
5,746,232 A 5/1998 Martin et al.
5,765,571 A 6/1998 Dinnel
D397,040 S 8/1998 Bakic
5,813,418 A 9/1998 Pillars
D403,922 S 1/1999 Terracciano et al.
D404,531 S 1/1999 Bakic et al.
5,894,846 A 4/1999 Gang
5,896,996 A 4/1999 Chuang
D411,649 S 6/1999 Bakic
D418,253 S 12/1999 Bakic
6,003,467 A 12/1999 Shelton-Ferrell et al.
6,016,814 A 1/2000 Elliott
6,019,107 A 2/2000 Overmyer et al.
6,029,674 A 2/2000 Han
6,032,609 A 3/2000 Luoma
6,035,861 A 3/2000 Copello
6,092,291 A 7/2000 Cendoma
6,109,274 A 8/2000 Ingersoll
D437,086 S 1/2001 Dickert
6,174,321 B1 1/2001 Webb
D442,304 S 5/2001 Huang
6,230,715 B1 5/2001 Cho
D443,471 S 6/2001 Lillelund et al.
6,247,476 B1 6/2001 Sartena
6,257,250 B1 7/2001 Sartena
6,265,010 B1 7/2001 Franco
D448,927 S 10/2001 Vazquez
6,302,115 B1 10/2001 Sartena
6,308,716 B1 10/2001 Han
D452,151 S 12/2001 Scott
D454,981 S 3/2002 Lamagna et al.
D456,077 S 4/2002 Etter et al.
D456,097 S 4/2002 Lamagna
D458,413 S 6/2002 Boilen
6,405,736 B2 6/2002 Townsend
6,439,406 B1 8/2002 Duhon
D463,280 S 9/2002 Brozell
D463,744 S 10/2002 Brozell
D464,565 S 10/2002 Weinstein et al.
D464,877 S 10/2002 Weinstein et al.
6,471,515 B2 10/2002 Feuer
D467,800 S 12/2002 Chen et al.
6,494,212 B1 12/2002 Yamakoshi
6,530,379 B2 3/2003 Iosilevich
D472,675 S 4/2003 Lamagna

(56) References Cited

U.S. PATENT DOCUMENTS

D472,810 S 4/2003 Gelardi
D473,106 S 4/2003 Scherer
6,561,197 B2 5/2003 Harrison
6,567,640 B2 5/2003 Ishikawa
D475,616 S 6/2003 Lambrecht
6,581,609 B2 6/2003 Ott
D479,365 S 9/2003 Todeschini
D481,946 S 11/2003 Nicholson et al.
D481,952 S 11/2003 Orsomando
D482,495 S 11/2003 Jackel-Marken
D482,928 S 12/2003 Liu
D483,232 S 12/2003 Liu
D483,633 S 12/2003 Jansson et al.
D483,909 S 12/2003 Todeschini
D485,359 S 1/2004 McMichael et al.
6,688,315 B1 2/2004 Harrison
6,691,714 B1 2/2004 Yaguchi et al.
6,708,696 B2 3/2004 Ferguson
D490,932 S 6/2004 Mammone
D495,834 S 9/2004 Todeschini
D496,759 S 9/2004 Rodriguez
6,820,625 B2 11/2004 Park
D501,580 S 2/2005 Sugawar
D506,573 S 6/2005 de Grandcourt
D507,678 S 7/2005 Lamagna
6,935,348 B2 8/2005 Gold
6,935,349 B2 8/2005 Nicot et al.
D509,942 S 9/2005 Connolly et al.
D512,913 S 12/2005 Gauthier
6,973,931 B1 12/2005 King
6,981,814 B2 1/2006 Geardino et al.
D515,242 S 2/2006 Cho
D516,247 S 2/2006 Merheje
7,000,775 B2 2/2006 Gelardi
7,036,518 B2 5/2006 Park
D522,376 S 6/2006 Hales
D532,891 S 11/2006 Buthier et al.
D533,650 S 12/2006 Ohta
D534,426 S 1/2007 Bakic
7,168,432 B1 1/2007 Brumfield
D537,208 S 2/2007 Shaljian
D540,112 S 4/2007 Nichols et al.
D543,662 S 5/2007 Bivona et al.
D543,663 S 5/2007 Bivona et al.
D543,815 S 6/2007 Metcalf
D543,850 S 6/2007 Legros
D544,148 S 6/2007 Bivona et al.
D544,202 S 6/2007 Markfelder
D545,396 S 6/2007 Casey et al.
7,228,863 B2 6/2007 Dumler et al.
D546,002 S 7/2007 Bowen
D547,940 S 8/2007 Sandy
D559,457 S 1/2008 Garland et al.
D561,045 S 2/2008 Lee
D561,942 S 2/2008 Khubani
7,331,351 B1 2/2008 Asai
D563,157 S 3/2008 Bouveret et al.
D563,616 S 3/2008 Lynde et al.
D563,728 S 3/2008 Welch, III
7,343,921 B2 3/2008 Salinas
D569,041 S 5/2008 Azoulay
D569,553 S 5/2008 Cho
7,374,048 B2 5/2008 Mazurek
D573,308 S 7/2008 Wittke-Kothe
D575,904 S * 8/2008 Iqbal ..... D24/143
7,469,701 B1 12/2008 Bernard
D584,449 S 1/2009 Shaljian
D588,746 S * 3/2009 Ross ..... D28/55
D591,599 S 5/2009 Okin et al.
D592,923 S 5/2009 Konopka
7,533,676 B2 5/2009 Sthair
D595,054 S 6/2009 Whitaker
7,543,718 B2 6/2009 Simon
D600,441 S 9/2009 Estrada
D602,354 S 10/2009 Dibnah et al.
7,600,519 B2 10/2009 Dinh
D604,579 S 11/2009 Robinson et al.
7,610,921 B2 11/2009 Gold
D605,514 S 12/2009 Weber
D607,332 S 1/2010 Huntington et al.
D615,290 S 5/2010 Heffner
D617,187 S 6/2010 Murray
D617,943 S 6/2010 Bouix et al.
D618,078 S 6/2010 Cripps et al.
7,748,391 B2 7/2010 Vance
D627,103 S 11/2010 Cho
7,836,899 B2 11/2010 Sugai et al.
D631,606 S 1/2011 Chen
D638,733 S 5/2011 Sullivan et al.
D639,196 S 6/2011 Sullivan et al.
D640,005 S 6/2011 Lee et al.
D640,834 S 6/2011 Chen
D641,106 S 7/2011 Williams et al.
8,015,980 B2 9/2011 Rabe et al.
8,025,065 B2 9/2011 Guliker
8,042,553 B2 10/2011 Paris
D647,799 S 11/2011 Dunwoody
8,061,367 B2 11/2011 Rabe et al.
D650,669 S 12/2011 Dunwoody
D650,670 S 12/2011 Dunwoody
D651,082 S 12/2011 Dunwoody
8,113,218 B2 2/2012 Nguyen
8,127,774 B2 3/2012 Dinh
D657,496 S 4/2012 Flatt
D657,696 S 4/2012 Floyd et al.
D659,330 S 5/2012 Davis
8,171,943 B2 5/2012 Hamano
8,186,361 B2 5/2012 Hampton
D661,185 S 6/2012 Battat
D661,599 S 6/2012 Floyd et al.
8,191,556 B2 6/2012 Betts
8,196,591 B2 6/2012 Lee et al.
8,205,761 B2 6/2012 Stull
D664,011 S 7/2012 Affonso
8,225,800 B2 7/2012 Byrne
D669,223 S 10/2012 Lee et al.
D670,030 S 10/2012 Nguyen
D673,325 S 12/2012 Martines
8,342,186 B2 1/2013 Freelove
8,347,896 B2 1/2013 Liao
D679,590 S 4/2013 Stull, Sr. et al.
D679,595 S 4/2013 Stull, Sr. et al.
D679,596 S 4/2013 Stull, Sr. et al.
D682,103 S 5/2013 Jedlicka et al.
D682,688 S 5/2013 Murray
8,434,500 B2 5/2013 Alex
D686,495 S 7/2013 Murray
D690,419 S 9/2013 Porat
8,528,571 B2 9/2013 Costa
8,578,946 B2 11/2013 Ellery
8,596,284 B2 12/2013 Byrne
8,616,223 B2 12/2013 Rabe et al.
D698,078 S 1/2014 Purizhansky et al.
8,657,170 B2 2/2014 Martinez
D700,799 S 3/2014 Ludeman et al.
8,701,685 B2 4/2014 Chipman
D707,392 S 6/2014 Spakowski
D707,556 S 6/2014 Kawamura
8,739,803 B2 6/2014 Freelove
8,752,562 B2 6/2014 Dinh
D709,129 S 7/2014 Moertl
D711,227 S 8/2014 Sheikh
D713,217 S 9/2014 Micara-Sartori et al.
D714,494 S 9/2014 Vasquez et al.
8,826,919 B2 9/2014 Dinh
D716,498 S * 10/2014 Wolff ..... D28/55
D717,536 S 11/2014 Gupta
D718,498 S * 11/2014 Gu ..... D28/55
8,875,718 B2 11/2014 Dinh
8,881,741 B1 11/2014 Mattson et al.
8,881,744 B2 11/2014 McKinstry
D718,901 S 12/2014 Parker
8,939,159 B2 1/2015 Yeo et al.
8,967,158 B2 3/2015 Sanbonmatsu

(56) References Cited

U.S. PATENT DOCUMENTS 9,004,299 B2 4/2015 Hardin
9,027,568 B2 5/2015 Lee
9,044,076 B2 6/2015 Temple
9,078,480 B2 7/2015 Beschta
9,107,461 B2 8/2015 Martins et al.
D738,579 S 9/2015 Owens et al.
D738,611 S 9/2015 Gupta
9,149,083 B1 10/2015 Dinh
9,155,345 B2 10/2015 Nisim et al.
9,179,722 B2 11/2015 Le
D746,514 S 12/2015 Lambridis et al.
9,215,901 B1 12/2015 Schroeder
9,254,012 B2 2/2016 Pham
D751,904 S 3/2016 Landrum et al.
9,277,777 B2 3/2016 Lee et al.
9,284,111 B2 3/2016 Huang
D753,455 S 4/2016 Hyma et al.
D753,881 S 4/2016 Hussain et al.
9,314,085 B2 4/2016 Hatch
D755,577 S 5/2016 Segal
D757,274 S 5/2016 Gelb et al.
D758,009 S 5/2016 Berkos
9,339,072 B2 5/2016 Kenna
9,351,752 B2 5/2016 Slavin
D761,489 S 7/2016 Krakovszki
D762,433 S 8/2016 Yang
D764,688 S 8/2016 Robinson et al.
D765,909 S 9/2016 Marchica et al.
9,439,465 B2 9/2016 Ott
9,451,800 B2 9/2016 Dinh
9,456,646 B2 10/2016 Calina
9,462,837 B2 10/2016 Ngo
9,468,245 B2 10/2016 Woods
9,486,025 B1 11/2016 Dinh
9,504,285 B2 11/2016 Lin
D773,915 S 12/2016 Barakat et al.
D775,270 S 12/2016 Moffat
9,516,908 B2 12/2016 Miyatake et al.
9,565,883 B2 2/2017 Dinh
9,596,898 B2 3/2017 Seawright
D783,899 S 4/2017 Roh
D783,901 S * 4/2017 Kim ..... D28/55
D784,615 S 4/2017 Choi
9,622,527 B2 4/2017 Nguyen
D788,556 S 6/2017 James
9,730,481 B2 8/2017 Uresti
D796,582 S 9/2017 Beard
D800,966 S 10/2017 Silva
D805,135 S 12/2017 Beard
D806,315 S 12/2017 Hardwick
9,833,028 B2 12/2017 Jang et al.
9,848,661 B2 12/2017 Harris et al.
9,848,662 B2 12/2017 Dinh
D810,534 S 2/2018 Liu
D810,543 S 2/2018 Astradsson et al.
D811,872 S 3/2018 Wu
D814,107 S 3/2018 Lotti et al.
D814,260 S 4/2018 Dhubb
9,930,919 B1 4/2018 Branker et al.
D817,132 S 5/2018 Yang
D819,891 S 6/2018 Kenig et al.
9,993,373 B2 6/2018 Nassif et al.
D823,538 S 7/2018 Ruggaber
D823,683 S 7/2018 Caldwell
D825,333 S 8/2018 Ozamiz et al.
D828,013 S 9/2018 Van Wijngaarden et al.
D828,014 S 9/2018 Van Wijngaarden et al.
D828,629 S 9/2018 Hussain
D829,381 S 9/2018 Kim
D830,170 S 10/2018 Holmes
D832,701 S 11/2018 Oates
D832,702 S 11/2018 Oates
D835,465 S 12/2018 Son et al.
D836,432 S 12/2018 Riedel
10,149,528 B2 12/2018 Erickson et al.
D836,943 S 1/2019 Klieman
D837,653 S 1/2019 Meranus
D840,104 S * 2/2019 Hussain ..... D28/55
10,264,837 B2 4/2019 Park
D847,631 S 5/2019 Villbrandt
D847,632 S 5/2019 Villbrandt
D848,795 S 5/2019 Butler
D850,715 S 6/2019 Lotti
D852,412 S 6/2019 Abraham
10,362,823 B1 7/2019 Hill et al.
D863,679 S 10/2019 Lotti
10,433,607 B2 10/2019 Ahn
D867,664 S 11/2019 Lotti
D867,668 S 11/2019 Lotti
D871,673 S 12/2019 Qureshi et al.
D877,416 S 3/2020 Lotti
D884,273 S * 5/2020 Liu ..... D28/36
10,660,388 B2 5/2020 Lotti
D890,430 S 7/2020 Lotti
10,721,984 B2 7/2020 Lotti
D895,201 S 9/2020 Lotti
D909,680 S 2/2021 Hussain
D914,965 S 3/2021 Lotti
D932,101 S 9/2021 Davis
D937,482 S * 11/2021 Kim ..... D28/7
11,446,017 B2 * 9/2022 Klassen ..... A61B 3/0083
2001/0023699 A1 9/2001 Matthews
2001/0035192 A1 11/2001 Townsend
2001/0037813 A1 11/2001 Ra
2002/0056465 A1 5/2002 Shin
2002/0094507 A1 7/2002 Feuer
2002/0114657 A1 * 8/2002 Gueret ..... A45D 34/04
401/130
2002/0198597 A1 12/2002 Godfrey
2003/0005941 A1 1/2003 Iosilevich
2003/0111467 A1 6/2003 Norman et al.
2003/0155317 A1 8/2003 McNeeley et al.
2003/0226571 A1 12/2003 Rahman
2004/0011371 A1 1/2004 Harrison
2004/0011372 A1 * 1/2004 Park ..... A41G 5/008
132/201
2004/0173233 A1 * 9/2004 Tokko ..... A41G 5/0086
132/201
2004/0211436 A1 10/2004 Knight
2005/0061341 A1 3/2005 Choe
2005/0098190 A1 5/2005 Kim
2005/0098191 A1 5/2005 Frazier
2005/0115581 A1 6/2005 Choi
2005/0166939 A1 8/2005 Stroud
2005/0194015 A1 9/2005 Watts
2005/0247326 A1 11/2005 Park
2005/0252517 A1 11/2005 Salinas
2005/0252518 A1 11/2005 Salinas
2006/0065280 A1 3/2006 Cheung
2006/0065281 A1 3/2006 Kim
2006/0081267 A1 4/2006 Kuptiz
2006/0096609 A1 5/2006 Nwokola
2006/0124658 A1 6/2006 Coe et al.
2006/0129187 A1 6/2006 Cho
2006/0175853 A1 * 8/2006 Anderson ..... B25B 9/02
294/99.2
2006/0180168 A1 8/2006 Dinnel
2006/0180171 A1 8/2006 Kim
2006/0266376 A1 11/2006 Basso
2007/0023062 A1 2/2007 McKinstry et al.
2007/0050207 A1 3/2007 Merszei
2007/0157941 A1 7/2007 Awad et al.
2007/0157944 A1 7/2007 Catron et al.
2007/0199571 A1 8/2007 McCulloch
2007/0221240 A1 9/2007 Junsuh Lee
2007/0227550 A1 10/2007 Merszei
2007/0272263 A1 11/2007 Gold
2007/0272264 A1 11/2007 Byrne
2007/0295353 A1 12/2007 Dinh
2008/0017210 A1 1/2008 Eaton
2008/0196732 A1 8/2008 Merszei
2008/0223390 A1 9/2008 Brown
2008/0276949 A1 11/2008 Lee
2008/0283072 A1 11/2008 Sun

(56) References Cited

U.S. PATENT DOCUMENTS

2009/0014023 A1 1/2009 Waters
2009/0026676 A1 1/2009 Kurita et al.
2009/0028625 A1 1/2009 Bonneyrat
2009/0071490 A1 3/2009 Sthair
2009/0071492 A1 3/2009 Oh
2009/0178689 A1 7/2009 Navarro et al.
2009/0217936 A1 9/2009 Sato et al.
2009/0217939 A1 9/2009 Rabe et al.
2009/0223534 A1 9/2009 Green
2009/0241973 A1 10/2009 Hampton
2009/0241979 A1 10/2009 Navarro et al.
2009/0255547 A1 10/2009 Starks et al.
2009/0266373 A1 10/2009 Kupitz
2009/0266376 A1 10/2009 Beschta
2010/0043816 A1 2/2010 Dix
2010/0065078 A1 3/2010 Reece
2010/0070526 A1 3/2010 Matias
2010/0170526 A1 7/2010 Nguyen
2011/0079233 A1 4/2011 Cheh
2011/0079235 A1 4/2011 Reed
2011/0079236 A1 4/2011 Lee
2011/0121592 A1 5/2011 Cho
2011/0127228 A1 6/2011 Sagel
2011/0220136 A1 9/2011 Kang
2011/0226274 A1 9/2011 Turner
2011/0240049 A1* 10/2011 Kim ..... B26B 13/06 132/200
2011/0278869 A1 11/2011 Lee et al.
2011/0290271 A1 12/2011 Rabe et al.
2012/0037177 A1 2/2012 Teater Makinen
2012/0055499 A1 3/2012 Sanbonmatsu
2012/0160259 A1 6/2012 Nguyen et al.
2012/0174939 A1 7/2012 Starks et al.
2012/0180804 A1 7/2012 Hochi et al.
2012/0266903 A1 10/2012 Devlin
2012/0305020 A1 12/2012 Byrne
2012/0318290 A1 12/2012 Kim
2013/0019889 A1 1/2013 Palmer-Rogers
2013/0032162 A1 2/2013 Major
2013/0042881 A1 2/2013 Mutchler
2013/0042884 A1 2/2013 Wilkinson
2013/0110032 A1 5/2013 Luzon et al.
2013/0160783 A1 6/2013 Ahn et al.
2013/0167855 A1 7/2013 Kupitz
2013/0167858 A1 7/2013 Lee
2013/0255706 A1 10/2013 Dinh
2013/0276807 A1 10/2013 Teater Makinen
2013/0298931 A1 11/2013 Samain et al.
2013/0306089 A1 11/2013 Araujo Costa
2013/0306094 A1 11/2013 West
2013/0312781 A1 11/2013 Murphy
2013/0312782 A1 11/2013 Kindall
2013/0320025 A1 12/2013 Mazzetta et al.
2013/0333714 A1 12/2013 Merszei
2014/0011372 A1 1/2014 Kato et al.
2014/0060559 A1 3/2014 Lin
2014/0069451 A1 3/2014 Hwang
2014/0083447 A1 3/2014 Rabe et al.
2014/0110304 A1 4/2014 Wu et al.
2014/0116456 A1 5/2014 Palmer-Rogers
2014/0135914 A1 5/2014 Conant
2014/0216488 A1 8/2014 Dinh
2014/0332025 A1 11/2014 Kim et al.
2015/0020840 A1 1/2015 Rabe et al.
2015/0075549 A1* 3/2015 Lee ..... A45D 44/00 132/53
2015/0114421 A1* 4/2015 Pham ..... A41G 5/02 132/201
2015/0114422 A1 4/2015 Abraham et al.
2015/0114423 A1 4/2015 Sanbonmatsu
2015/0128986 A1 5/2015 Stookey
2015/0136162 A1 5/2015 Brouillet et al.
2015/0173442 A1 6/2015 Raouf
2015/0181967 A1 7/2015 Dinh
2015/0201691 A1 7/2015 Palmer-Rogers
2015/0201692 A1 7/2015 Hansen et al.
2015/0216246 A1 8/2015 Ahn et al.
2016/0016702 A1 1/2016 Siskindovich et al.
2016/0037847 A1 2/2016 Tavakoli
2016/0037848 A1 2/2016 Lee
2016/0050996 A1 2/2016 Kwon
2016/0058088 A1 3/2016 Le
2016/0088889 A1 3/2016 Kettavong
2016/0135531 A1 5/2016 Ezechukwu
2016/0174645 A1 6/2016 Goldner
2016/0192724 A1 7/2016 Scott et al.
2016/0192725 A1 7/2016 Merszei
2016/0206031 A1 7/2016 Stoka
2016/0219959 A1 8/2016 Chipman et al.
2016/0286881 A1 10/2016 Ko
2016/0324241 A2 11/2016 Lee
2016/0324242 A1 11/2016 Hansen et al.
2016/0345648 A1 12/2016 Miniello et al.
2016/0353821 A1 12/2016 Calina
2017/0000204 A1 1/2017 Wibowo
2017/0006947 A1 1/2017 Uresti
2017/0020219 A1 1/2017 Beschta
2017/0049172 A1 2/2017 Ahn
2017/0049173 A1 2/2017 Dinh
2017/0055615 A1 3/2017 Crocilla
2017/0079356 A1 3/2017 Dinh
2017/0079357 A1 3/2017 Dinh
2017/0079358 A1 3/2017 Dinh
2017/0112214 A1 4/2017 Ahn
2017/0112215 A1 4/2017 Dinh
2017/0112264 A1 4/2017 Park
2017/0127743 A1 5/2017 Nakamura et al.
2017/0150763 A1 6/2017 Schroeder
2017/0208885 A1 7/2017 Alex
2017/0231309 A1 8/2017 Han
2017/0258163 A1* 9/2017 Uresti ..... A41G 5/0086
2017/0265550 A1 9/2017 Han et al.
2017/0311667 A1 11/2017 Passariello et al.
2017/0340041 A1 11/2017 Nguyen
2017/0347731 A1 12/2017 Chipman et al.
2017/0358245 A1 12/2017 Dana
2017/0360134 A1 12/2017 Crocilla
2017/0360135 A1 12/2017 Ahn
2017/0360136 A1 12/2017 Ferrier et al.
2018/0065779 A1 3/2018 Chiba
2018/0098591 A1* 4/2018 Leeflang ..... A41G 5/0086
2018/0160755 A1 6/2018 Hansen et al.
2018/0235299 A1 8/2018 Stoka
2018/0242671 A1 8/2018 Merszei
2018/0242672 A1 8/2018 Lotti
2018/0242715 A1 8/2018 Lotti
2018/0352885 A1 12/2018 Kim
2018/0352886 A1 12/2018 Schroeder et al.
2019/0133227 A1 5/2019 Le
2019/0191851 A1 6/2019 Esposito et al.
2019/0254373 A1* 8/2019 Kim ..... A41G 5/02
2019/0254374 A1 8/2019 Schroeder
2020/0093211 A1 3/2020 Lee
2020/0260839 A1 8/2020 Lotti
2021/0337949 A1* 11/2021 Ardin ..... A45D 2/48

FOREIGN PATENT DOCUMENTS

CN 102975141 A 3/2013
CN 103027410 A 4/2013
CN 205274180 4/2013
CN 203897379 U 10/2014
CN 104363790 A 2/2015
CN 205274180 U 6/2016
CN 304049505 S 2/2017
CN 304049506 S 2/2017
CN 304310042 S 10/2017
CN 304329374 S 10/2017
CN 304329375 S 10/2017
CN 304382151 S 12/2017
CN 304452297 1/2018
CN 304497372 S 2/2018
CN 304777737 S 8/2018
CN 304859863 S 10/2018

(56) References Cited

FOREIGN PATENT DOCUMENTS

| | | | | | |
|---|---|---|---|---|---|
| CN | 304859864 | S | | 10/2018 | |
| CN | 305916370 | | | 4/2019 | |
| CN | 305738664 | | | 4/2020 | |
| EM | 0063812570002 | | | 4/2019 | |
| EM | 0063812570003 | | | 4/2019 | |
| EP | 1839526 | A1 | | 10/2007 | |
| EP | 1839526 | B1 | | 7/2009 | |
| EP | 006381257 | | | 4/2019 | |
| EP | 006381257-0001 | | | 4/2019 | |
| EP | 006381257-0002 | | | 4/2019 | |
| FR | 1435971 | A | * | 4/1966 | ..... A45D 26/0066 |
| GB | 1021063 | | | 2/1966 | |
| GB | 1021063 | A | * | 2/1966 | ..... A41G 5/02 |
| GB | 1263815 | A | * | 2/1972 | ..... A41G 5/02 |
| GB | 1272616 | A | | 5/1972 | |
| GB | 1307107 | A | | 2/1973 | |
| GB | 1307107 | A | * | 2/1973 | ..... A41G 5/02 |
| JP | S471395 | U | | 8/1972 | |
| JP | 487948 | B | | 1/1973 | |
| JP | 48-007948 | | | 3/1973 | |
| JP | 486773 | A | | 9/1974 | |
| JP | 4993157 | | | 9/1974 | |
| JP | 2010137329 | A | | 6/2010 | |
| JP | 2011500979 | A | | 1/2011 | |
| JP | 2011106066 | A | | 6/2011 | |
| JP | 2011122288 | A | | 6/2011 | |
| JP | 2011177395 | A | | 9/2011 | |
| JP | 3175232 | U | | 4/2012 | |
| JP | 2015105447 | A | | 6/2015 | |
| JP | 3201846 | U | | 1/2016 | |
| JP | 2016027220 | A | | 2/2016 | |
| JP | 2016163699 | A | | 9/2016 | |
| JP | 2019522125 | A | | 8/2019 | |
| KR | 200165452 | Y1 | | 2/2000 | |
| KR | 100450341 | B1 | | 10/2004 | |
| KR | 20090010717 | A | | 1/2009 | |
| KR | 101336422 | B1 | | 12/2013 | |
| KR | 101392845 | B1 | | 5/2014 | |
| KR | 101509029 | | | 4/2015 | |
| KR | 20150140672 | A | | 12/2015 | |
| WO | 2014163364 | A1 | | 10/2014 | |
| WO | 2017086254 | A1 | | 5/2017 | |
| WO | 2018002914 | A1 | | 1/2018 | |
| WO | WO2018/022914 | | | 1/2018 | |
| WO | 2018119034 | A1 | | 6/2018 | |
| WO | WO-2018119034 | A1 | * | 6/2018 | ..... A41G 5/02 |

OTHER PUBLICATIONS

Amazon, Ocamo False Eyelashes Curler Stainless Steel Extension Eye Lash Applicator Remover Tweezers Clip Makeup Tools, https://www.amazon.kin/Ocamo-Eyelashes-Stanless-Extension-Applicator/dp/B07FT5XW8C?tag=googinhydr18418-21&tag=googinkenshoo-21&ascsu . . . , downloaded from internet Oct. 10, 2018 (3 pages).

Born Pretty, False Eyelashes Thick Natural Simulation Recyclable Curly False Eyelash Makeup Cosmetic Tools , http://www.bornprettystore.com/false-eyelashes-thick-natural-simulation-recyclable-curly-false-eyelash-makeup-cosmetic-tools-p-44675.htmldownloaded from internet Oct. 18, 2018 (6 pages).

Buy Korea, Plastic, False Eyelash Applicator, Multy colour, http//www.buykorea.or.kr/product-detalis/Plastic-False-Eyelash-Applicator-Multy-colour--3106709.html, downloaded from internet Feb. 14, 2019 (3 pages).

Cosmopolitan, You've Been Applying False Eyelashes Wrong Your Whole Life, https://www.cosmopolitan.com/style-beauty/beauty/how-to/a55781/this-false-eyelash-hack-will-change-your-life/, Mar. 25, 2016 (12 pages).

Delicate Hummingbird, Ha! I've mastered the false lashes!, http://delicatehummingbird.blogspot.com/2011/11/ha-ive-mastered-false-lashes.html, Nov. 10, 2011 (12 pages).

Dream Lashes Curved Volume Tweezer—3 Minute Test, https://www.youtube.com/watch?v=vwqYeE0SD7s, downloaded from the internet Feb. 13, 2019 (1 page).

Electron Microscopy Sciences, EMS High Precisions and Ultra Fine Tweezers, https://www.emsdiasum.com/microscopy/products/tweezers/ultra_fine.aspx, downloaded from the internet Feb. 13, 2019 (7 pages).

Focallure, https://shopfocallure.com/collections/eyelashes/products/eyelash-tweezer-by-focallure, downloaded from internet Feb. 14, 2019 (1 page).

Hongjun web page, https://detail.1688.com/offer/574685154983.html?spm=a2615.7691456.newlist.75.22f96dc5Msy00t, downloaded from internet Oct. 31, 2018 (16 pages).

Image Essentials, How to wear false eyelashes without looking like you're wearing them, https://imagessentials.wordpress.com/2012/03/30/how-to-wear-false-eyelashes-without-looking-like-youre-wearing-any/, Mar. 30, 2012 (5 pages).

International Search Report and Written Opinion dated Dec. 23, 2019 in related PCT/2019/057102 filed Oct. 19, 2019 (8 pages).

International Search Report and Written Opinion dated Mar. 12, 2018 in related PCT/2017/067513 filed Dec. 20, 2017 (10 pages).

International Search Report and Written Opinion dated Nov. 27, 2017 in related PCT/US2017/044217 filed Jul. 27, 2017 (10 pages).

Japonesque False Lash Applicator, https://japonesque.com/products/implements/false-lash-applicator/, downloaded from internet Feb. 13, 2019 (6 pages).

Lashify Wand, https://www.instagram.com/p/BWgeQ8wg00S/?iqshid=zauiyw8a6v5, downloaded from internet 2019 (1 page).

Madame Madeline Lashes, Ardell Dual Lash Applicator, https://www.madamemadeline.com/online_shoppe/proddetail.asp?prod=mm62059, downloaded from internet Oct. 18, 201 (3 pages).

Made in China, New Product Eyelashes Aid Eyelashes Applicator Innovative Eyelashes Curler, 2018, https://www.made-in-china.com/productdirectory.do?word=creative+eyelashe+curler&subaction=hunt&style=b&mode=and&code=0&comProvince=nolimit&order=0&isOpenCorrection=1, downloaded from internet Feb. 13, 2019 (2 pages).

Pak Lajpall, Nail Artist Tweezers PL-1, http://www.lajpall.com/proddetail.php?prod=nail-artist-tweezers_1, downloaded from internet Feb. 13, 2019 (1 page).

Peonies and Lilies, Bourjois 2 in 1 Tweezers and Faux & Fabulous Eyelashes, posted Oct. 24, 2012 (2 pages).

Buzludzha Monument, Gueorguy Stoilov circa 1980, justanotherbackpacker.com, published by blogger Rich on Apr. 29, 2014 © 2019, online, site visited Aug. 27, 2019. Downloaded from Internet, URL: http://www.justanotherbackpacker.com/ buzludzha-monument-bulgaria-ufo/ (Year: 2014).

Cruiser Portable Speaker, NYNE, published at thegamerwithkids.com, posted by Sam Versionone on Apr. 6, 2015 © not listed, online, cite visited Jun. 20, 2018. Available from Internet. URL: https://thegamerwithkids.com/2015/04/06/nyne-cruiser-review-a-wireless-speaker-for-your-bycicle/ (Year: 2015).

"34 Lash," MAC Cosmetics, Retrieved from URL: http://www.bornprettystore.com/false-eyelashes-thick-natural-simulation-recyclable-curly-false-eyelash-makeup-cosmetic-tools-p44675.html, on Feb. 14, 2019, 1 page.

Dream Lashes. "Dream Lashes Curved Volume Tweezer—3 Minute Test." YouTube, YouTube, Sep. 30, 2016. 1:15-1:30, 3:02.www.youtube.com//watch?v=vwqYeE0SD7s.

"EMS High Precisions and Ultra Fine Tweezers," Electron Microscopy Sciences, Dec. 10, 2015, p. 4. web.archive.org/web/20151210205103/https://www.emsdiasum.com/microscopy/products/tweezers/ultra_fine.aspx.

European Search Report issued in EP17835287A, dated Feb. 11, 2020, 5 pages.

Extended European Search Report for European Patent Application No. 17884561.6, dated Sep. 11, 2020, 8 Pages.

"Eyelash Tweezers—FEITA Precision Eyelash Extension Tweezers Set," retrieved from the Internet URL: https://www.amazon.com/Eyelash-Tweezers-Precision-Extension-Professional/dp/B01I2KSUDS?th=1, reviewed on Dec. 13, 2016 on amazon.com, retrieved on Dec. 31, 2018.

First Office Action issued in CN201780004312A, dated May 7, 2020, 17 pages.

First Office Action issued in CN201780033755A, dated Aug. 28, 2020, 8 pages.

(56) References Cited

OTHER PUBLICATIONS

International Preliminary Report issued in International Application No. PCT/US2017/067513, dated Jul. 4, 2019, 9 pages.
International Preliminary Report issued in International Application No. PCT/US2019/057102, dated Apr. 29, 2021, 8 pages.
International Preliminary Report issued in International Application No. PCT/US2019/057104, dated Apr. 29, 2021, 8 pages.
International Search Report and Written Opinion for International Application No. PCT/US2020/013561, dated May 7, 2020, 10 pages.
International Search report and Written Opinion issued in International Application No. PCT/US2019/057104, dated Dec. 19, 2019, 9 pages.
Lades, "Eyelashes Clip—2 Pieces False Eyelashes Applicator Tool Eyelash Extension Tweezers Remover Clip Nipper," #Amazon, URL: https://www.amazon.co.uk/Eyelashes-Clip-Applicator-Extension-Tweezers/dp/B07PK6VBVW, XP055720051, (Aug. 2, 2017), pp. 1-7.
"Lashify Gossamer Lash Cartridge," Retrieved from URL: https://lashify.com/collections/shop-1/products/gossamer-eye-lozenge-c-style?variant=783670738950, Jun. 15, 2018, 2 pages.
Plastic, False Eyelash Applicator, Multy colour, by Korea, copyright, Imported from a Related Application, 2013, 3 pages.
Rodulfo K., "This DIY Lash Extension Kit Has Ruined Mascara for Me Forever," retrieved from the Internet URL: https://www.elle.com/beauty/makeup-skin-care/a20704236/lashify-lashes-kit-review/, published on May 16, 2018 on elle.com, retrieved on Dec. 31, 2018.
United States District Court District of New Jersey, 2:20-cv-10023-JMV-MF, *Lashify, Inc.* v. *Kiss Nail Products, Inc*.
United States District Court District of California San Francisco Division, 3:20-cv-06086, *Lashify, Inc.* v. *Alicia Zeng and Patrick Ellsworth d/b/a Lilac St; and Artemis Family Beginnings, Inc*.
U.S. International Trade Commission, Inv. No. 337-TA-1226, In the Matter of Certain Artificial Eyelash Extension Systems, Products, and Components Thereof.
Patent Trial and Appeal Board (PTAB), PGR2021-00046, *Kiss Nail Products, Inc* (Petitioner) v. *Lashify, Inc* (Patent Owner).
Patent Trial and Appeal Board (PTAB), PGR2021-00045, *Kiss Nail Products, Inc* (Petitioner) v. *Lashify, Inc* (Patent Owner).
Dream Lashes Curved Volume Tweezer—3 Minute Test, https://www.youtube.com/watch?v:cw1qYeEOSD7s, downloaded from the internet Feb. 13, 2019 (1 paqe).
Eyelash Tweezers—FEITA Precision Eyelash Extension Tweezers Set—Professional Straight & Curved Pointed Very Fine Tip Tweezers for Lash Extensions—Black—2Pcs, amazon.com/Eyelash-Tweezers-Precision-Extension-Professional/dp/B01I2KSUDS.
"Eyelashes Clip—2 Pieces False Eyelashes Applicator Tool Eyelash Extension Tweezers Remover Clip Nipperamazon.co.uk/Eyelashes-Clip-Applicator-Extension-Tweezers/dp/B07PK6VBVW".
How to Apply Lashing using Sephora Bull Eye Lash Applicator, Nov. 14, 2012 youtube video, https://www.youtube.com/watch?v=yYwcYzXJX4M.
Volume Tweezers, Jun. 11, 2014 youtube video, https://www.youtube.com/watch?v=vvbDF18x2h8.

* cited by examiner

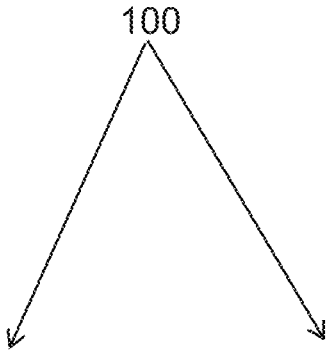
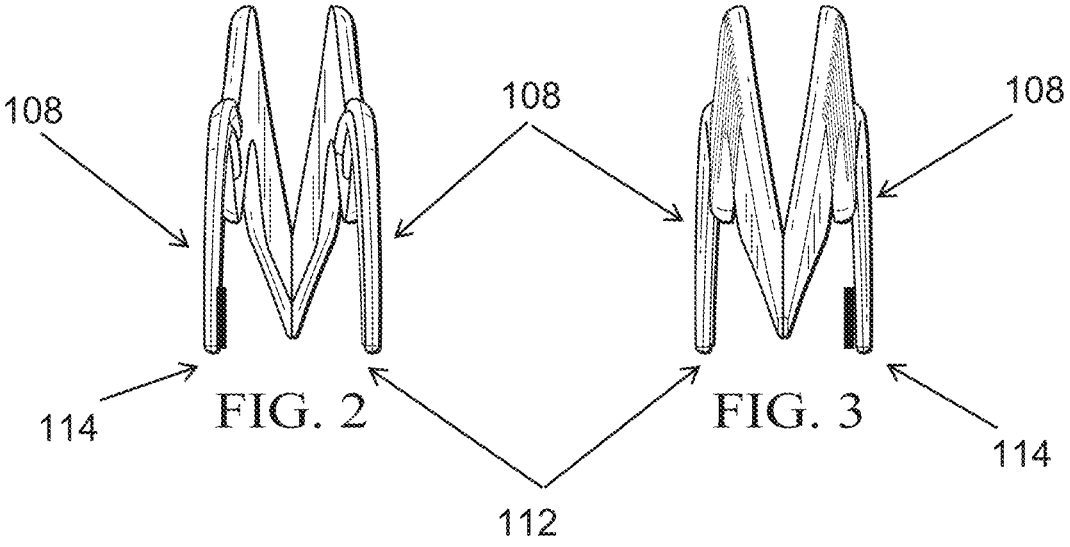
FIG. 2
FIG. 3

100

FIG. 6
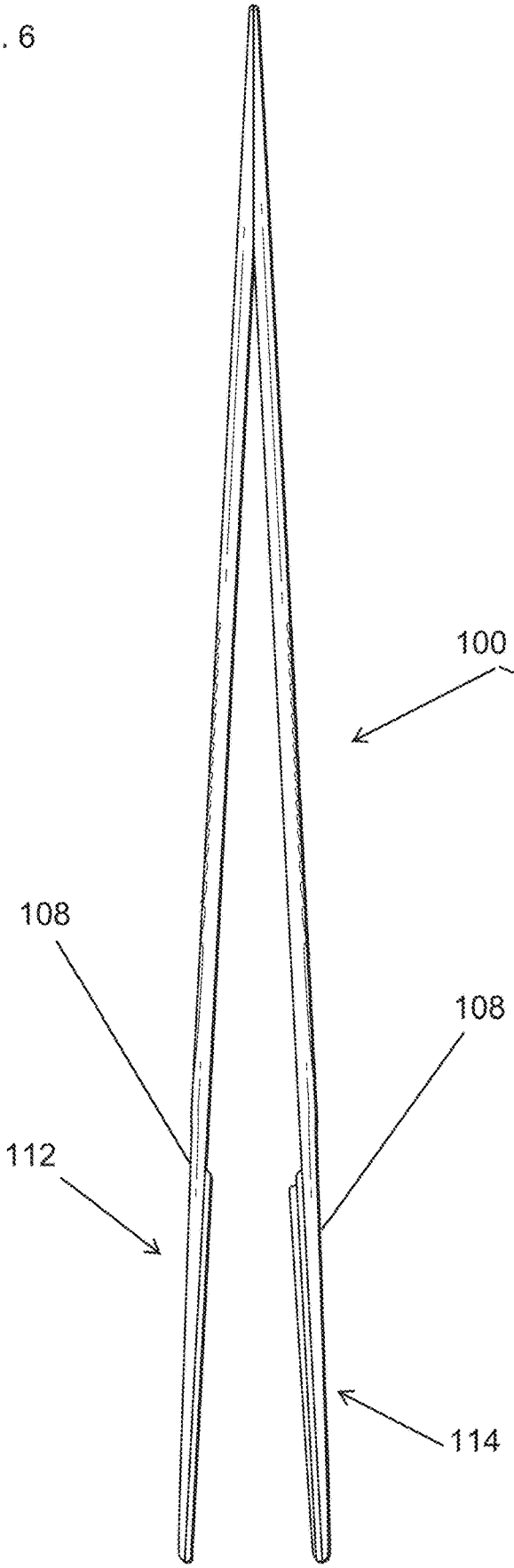
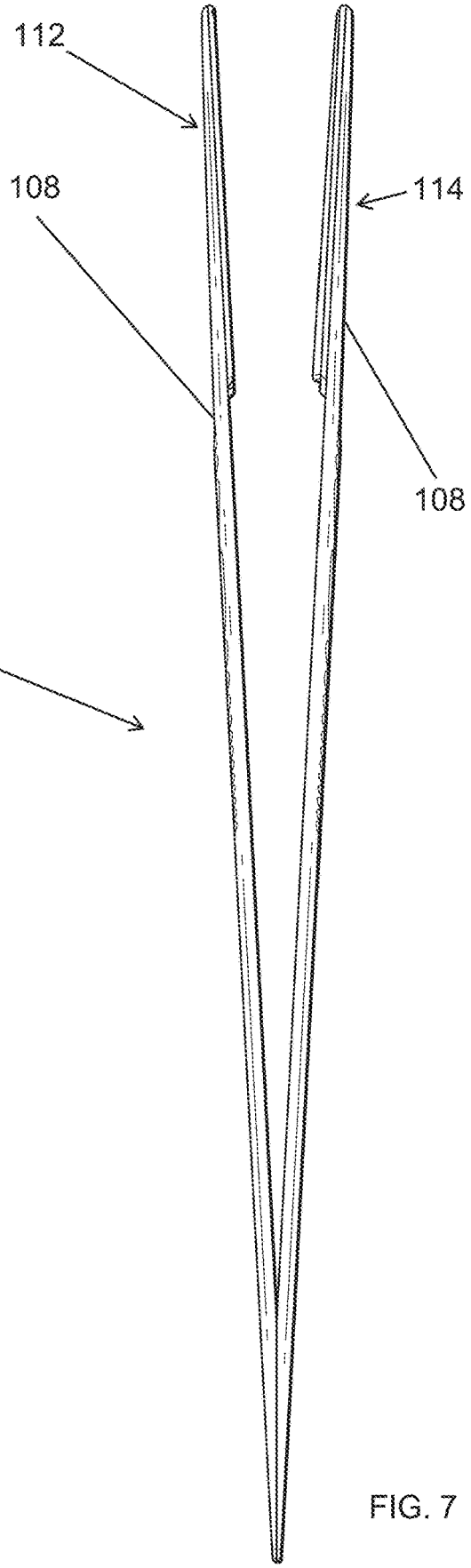
FIG. 7

FIG. 12
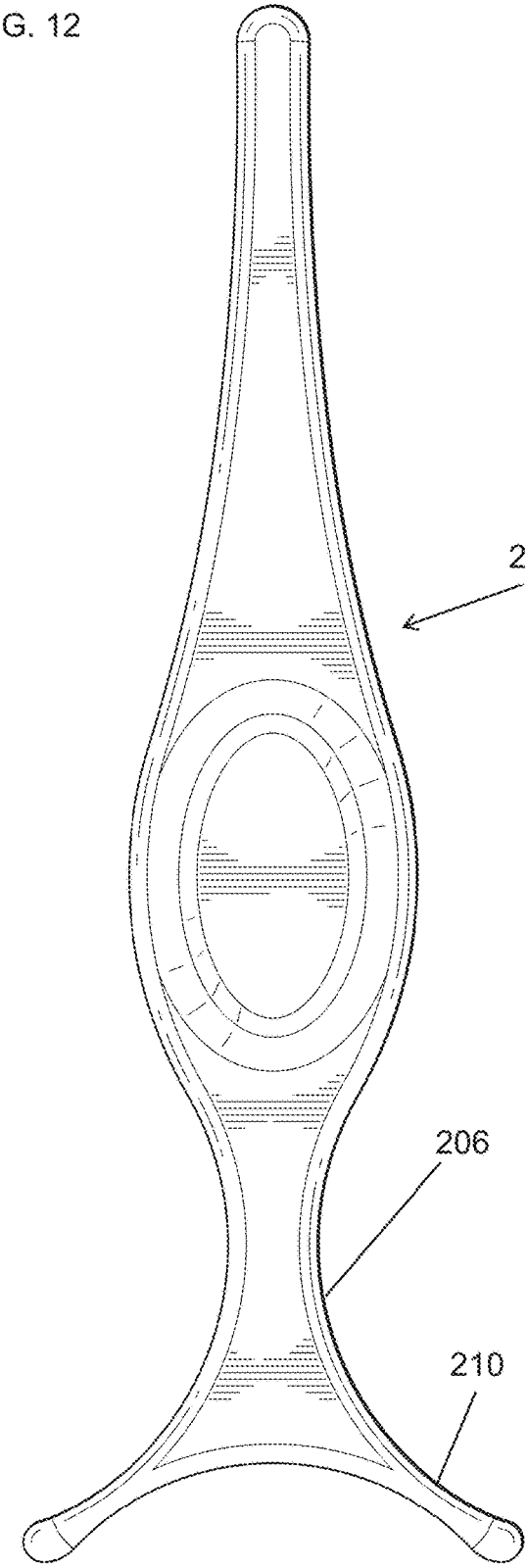
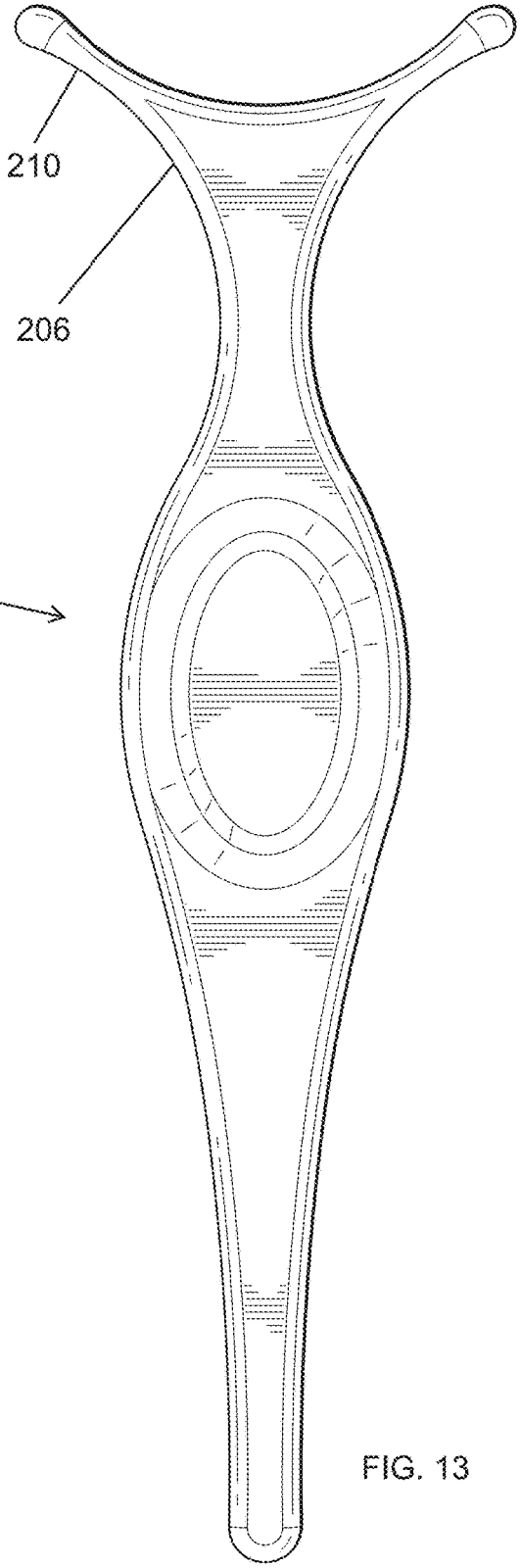
FIG. 13

FIG. 14
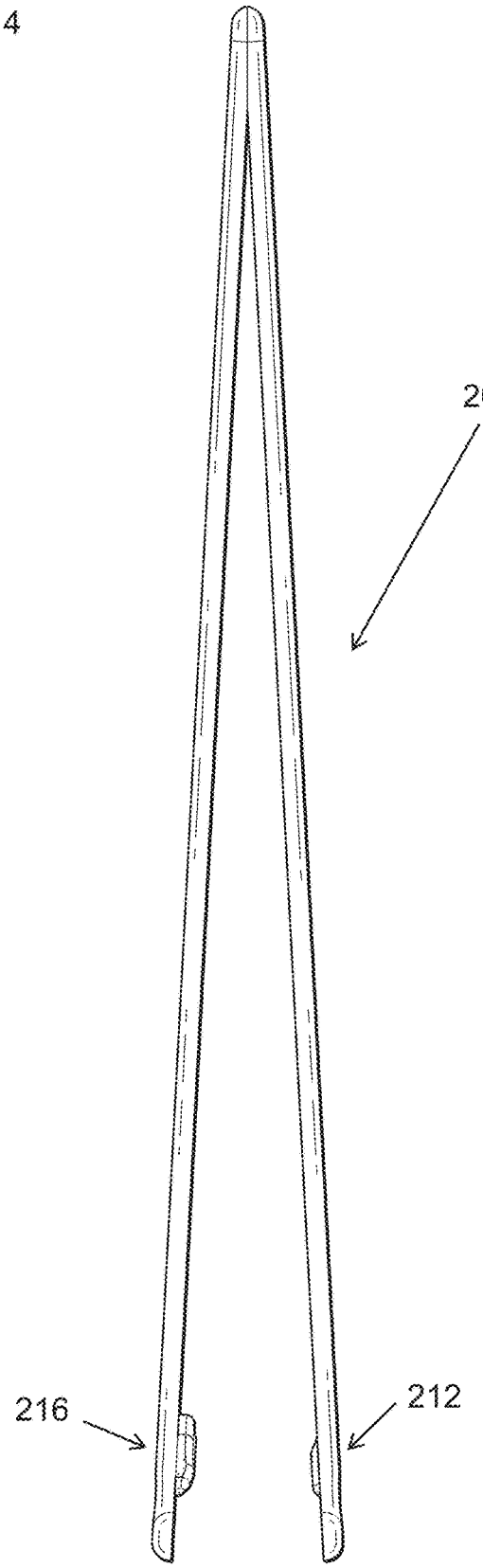
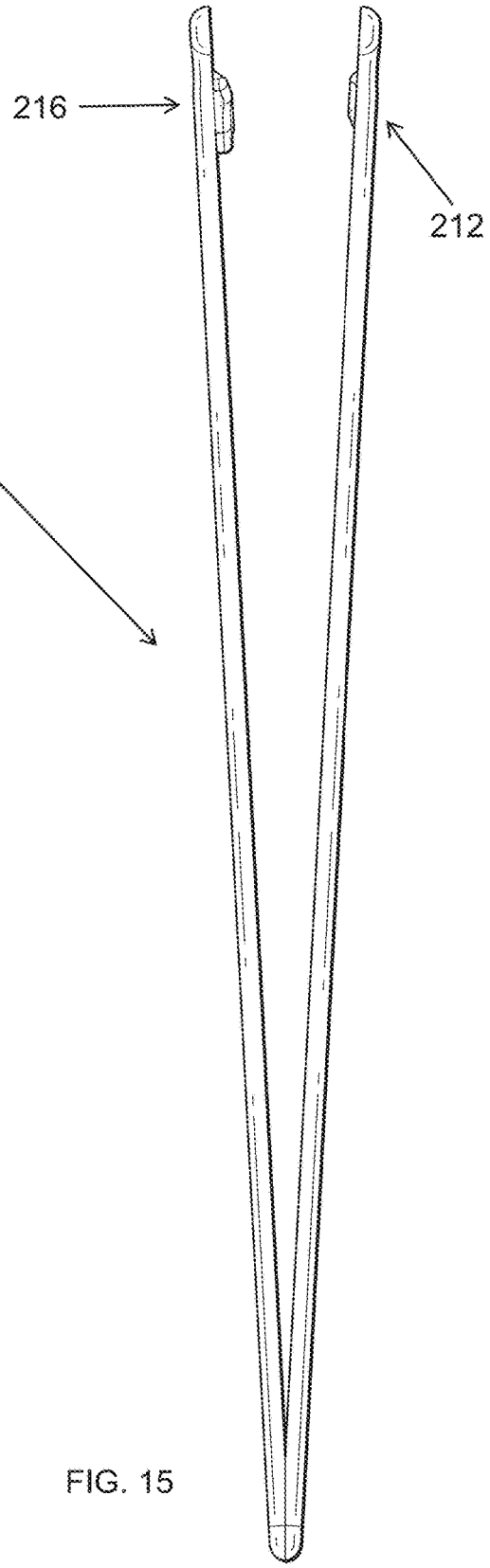
FIG. 15

APPLICATORS FOR APPLYING EYELASH EXTENSIONS AND METHODS FOR USE AND MANUFACTURE THEREOF

CROSS-REFERENCE TO RELATED PATENT APPLICATIONS

This patent application is a Continuation of U.S. Patent Application PCT/US2019/057102 filed 19 Oct. 2019; which claims a benefit of U.S. Provisional Patent Application 62/748,335 filed 19 Oct. 2018; each of which is incorporated herein by reference in its entirety for all purposes.

TECHNICAL FIELD

This disclosure relates to applicators for applying eyelash extensions to natural eyelashes.

BACKGROUND

An applicator can be used to apply an eyelash extension to a natural eyelash of a user via an adhesive. However, the adhesive may not properly adhere to the eyelash extension or the natural eyelash. For example, the adhesive may not spread properly or clump.

SUMMARY

Broadly, this disclosure enables applicators for applying eyelash extensions and methods for use and manufacture thereof. In particular, these applicators these applicators host male/female tips that can improve application of adhesives to eyelash extensions or natural eyelashes. Regardless of the applicators shaping (e.g., lash curler style) or not shaping the eyelash extensions or the natural eyelashes, the male/female tips aid, enable, or cause spreading of the adhesives (e.g., along male projections, within female depressions) or makes the adhesives less user visible (e.g., minimize clumping of adhesives).

In an embodiment, an applicator comprising: a first arm having a first grasping tip that is arcuate, wherein the first grasping tip has a first inner side hosting a male portion; and a second arm having a second grasping tip that is arcuate, wherein the second grasping tip has a second inner side hosting a female portion, wherein the first inner side faces the second inner side, wherein the male portion and the female portion avoid mating when the first arm and the second arm are at a default position, wherein the male portion and the female portion mate when the first arm and the second arm are at a grasping position.

In an embodiment, a method comprising: causing a lash extension to be grasped between a male portion of a first inner side of a first arcuate tip of a first arm of an applicator and a female portion of a second inner side of a second arcuate tip of a second arm of the applicator while the male portion and the female portion mate and the first inner side faces the second inner side; and causing the lash extension to be released onto a natural lash of the user via not mating the male portion and the female portion while the first inner side faces the second inner side.

Another embodiment of an applicator may include a first arm including a first grasping tip having a first inner side including at least one protrusion that defines a male portion. A second arm may include a second grasping tip having a second inner side including at least one depression that defines a female portion. The first inner side may face the second inner side such that the male portion and the female portion are aligned with one another such that when the first arm and the second arm are in an open position, the male and female portions are separated from one another, and when the first arm and second arm are in a closed position, the male portion and the female portion mate with one another.

Another embodiment of a method may include causing an adhesive holding a lash extension formed of multiple fibers and natural lashes together to be simultaneously grasped between at least one protrusion defining a male portion of a first inner side of a first tip of a first arm disposed on an applicator and at least one depression that defines a female portion disposed on a second inner side of a second tip of a second arm of the applicator, thereby causing the adhesive to be spread along a region between the male and female portions.

One embodiment of a method for redistributing an adhesive applied to a lash extension formed of multiple fibers and natural lashes may include causing the adhesive disposed on the natural lashes and lash extension to extend along a surface of an elongated depression disposed on a first tip of a first arm of an applicator and a surface of an elongated protrusion disposed on a second tip of a second arm when the elongated protrusion is vertically extended into the elongated depression with the adhesive, natural lashes, and lash extension being positioned between the elongated depression and elongated protrusion.

One embodiment of a method of manufacturing an applicator may include forming a first arm including a first grasping tip having a first inner side including at least one protrusion that defines a male portion, and forming a second arm including a second grasping tip having a second inner side including at least one depression that defines a female portion. The first and second arms may be connected at a first end opposite a second end at which the first and second grasping tips are located, and with the first inner side facing the second inner side. The male portion and the female portion may be aligned with one another so that when the first arm and the second arm are in an open position, the male and female portions are separated from one another, and when the first arm and second arm are in a closed position, the male portion and the female portion mate with one another.

DESCRIPTION OF DRAWINGS

FIGS. 1-8 show a plurality of views of an embodiment of an applicator according to this disclosure.

FIGS. 9-16 show a plurality of views of an embodiment of an applicator according to this disclosure.

DETAILED DESCRIPTION

Figure 1:
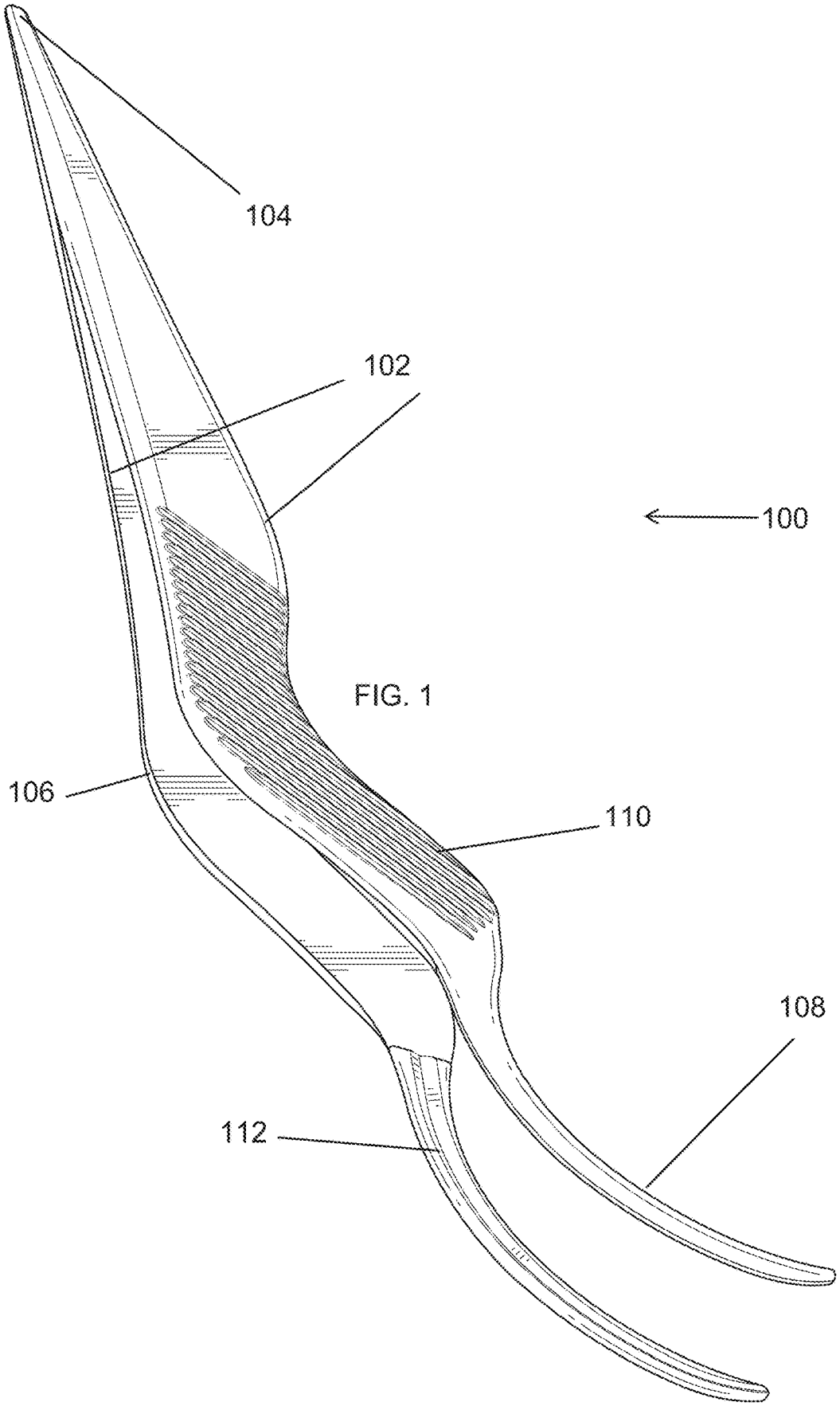
Figure 4:
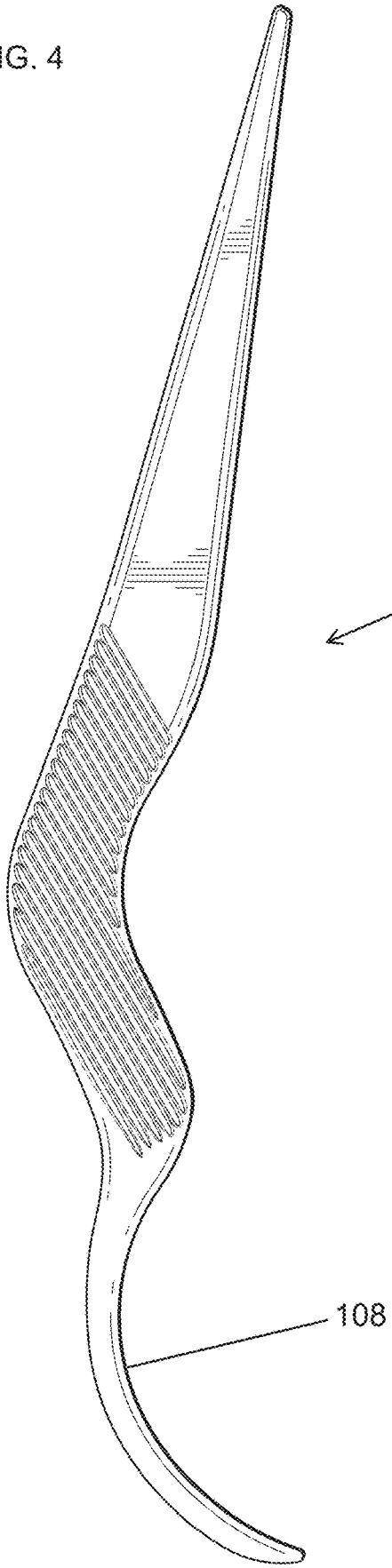
Figure 5:
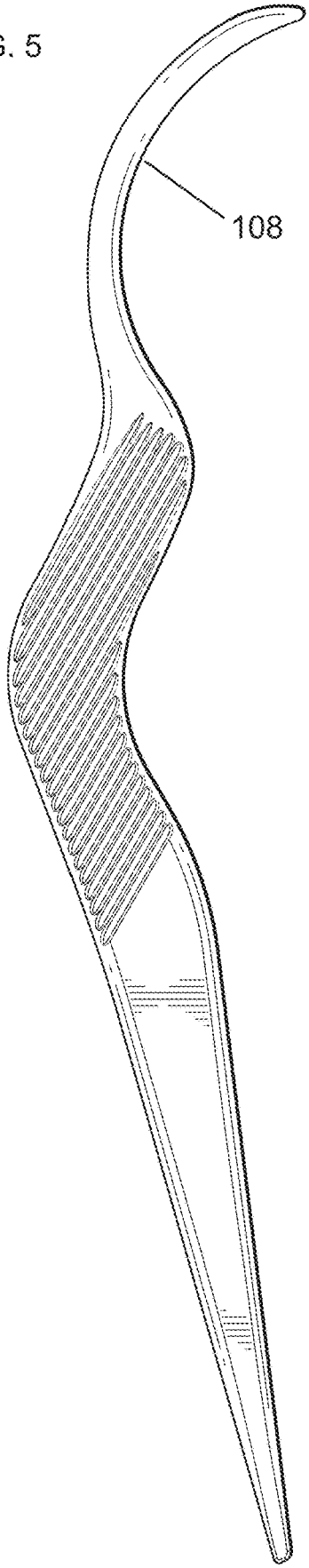
Figure 8:
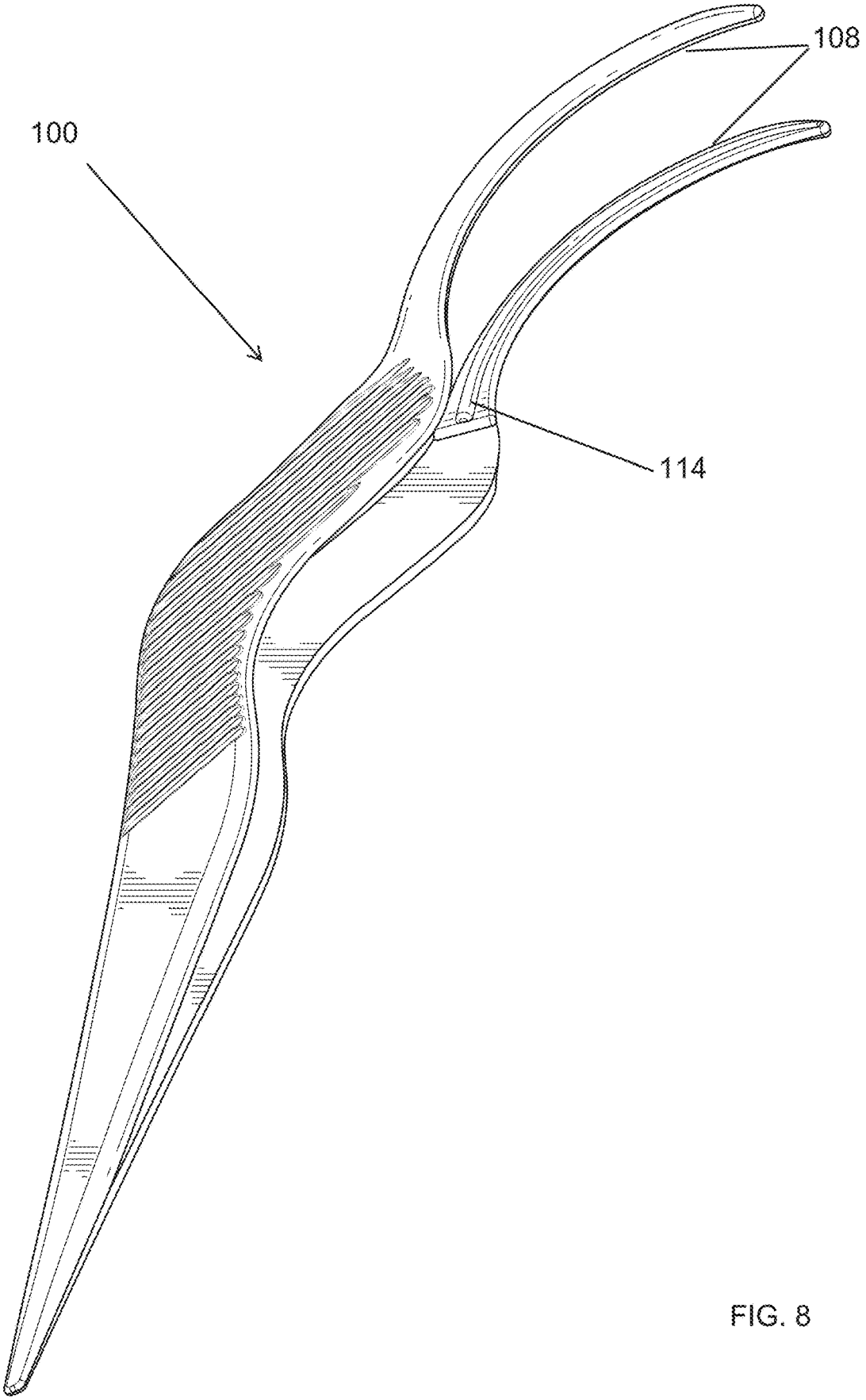
Figure 9:
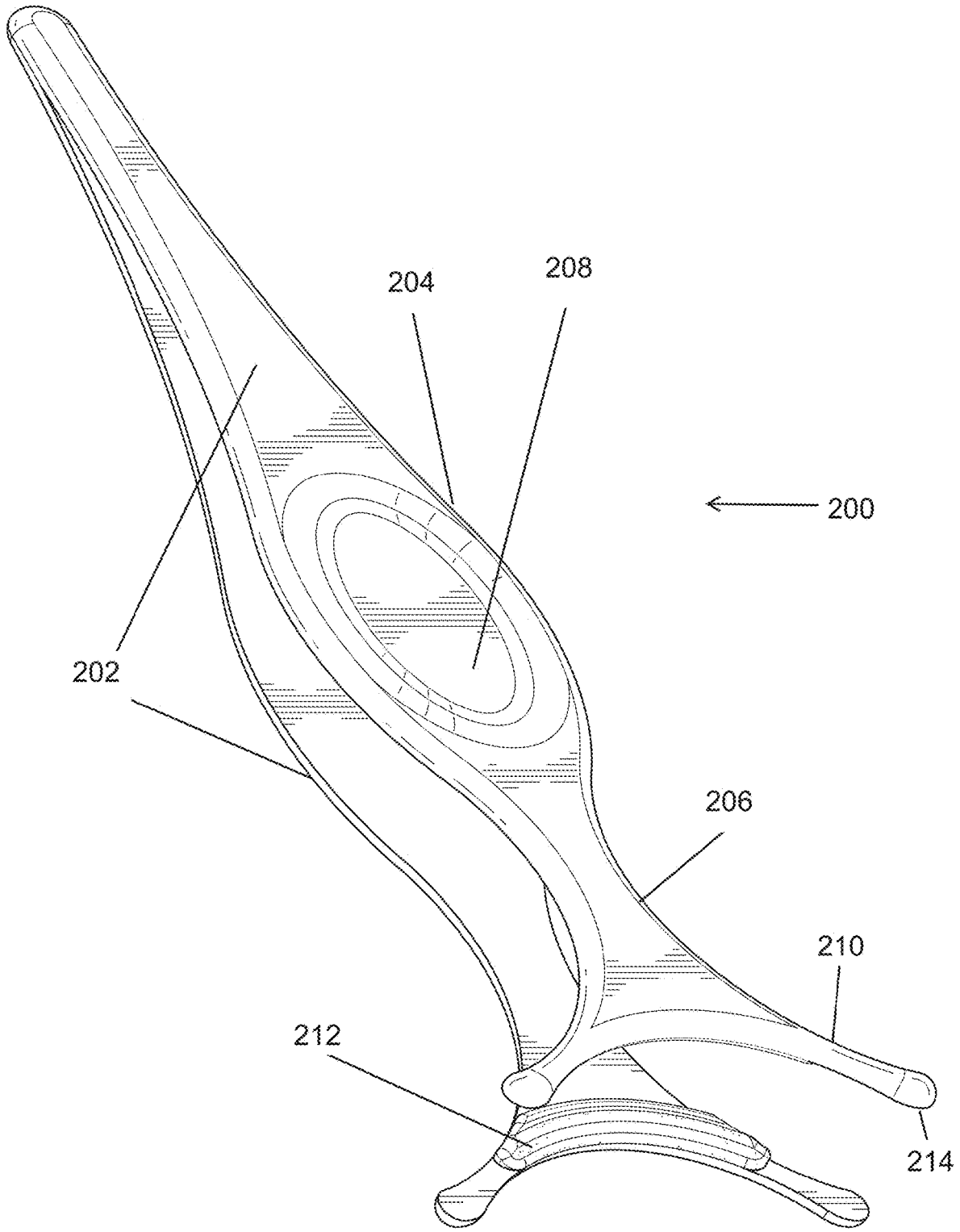
Figures 10, 11:
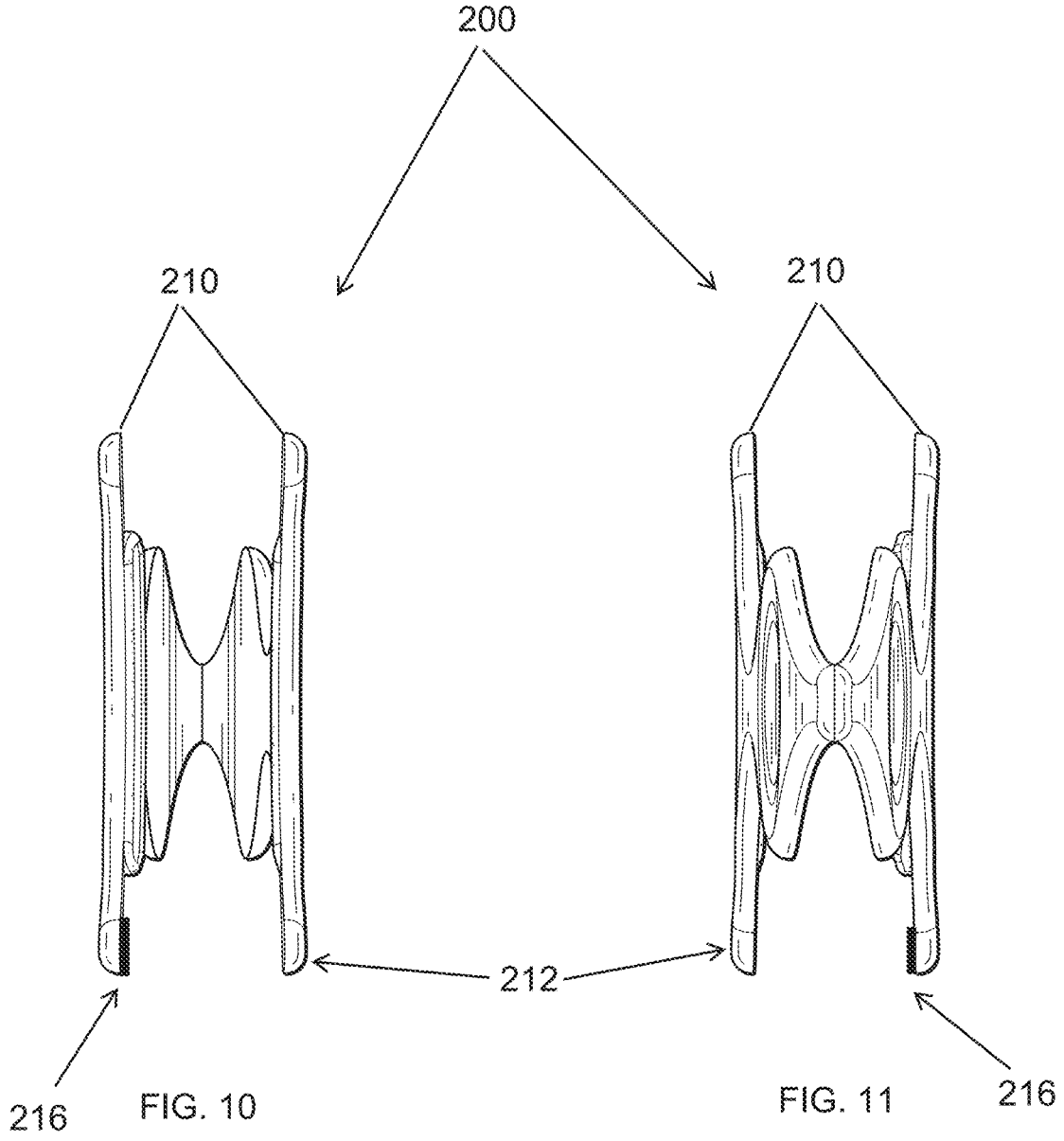
Figure 16:
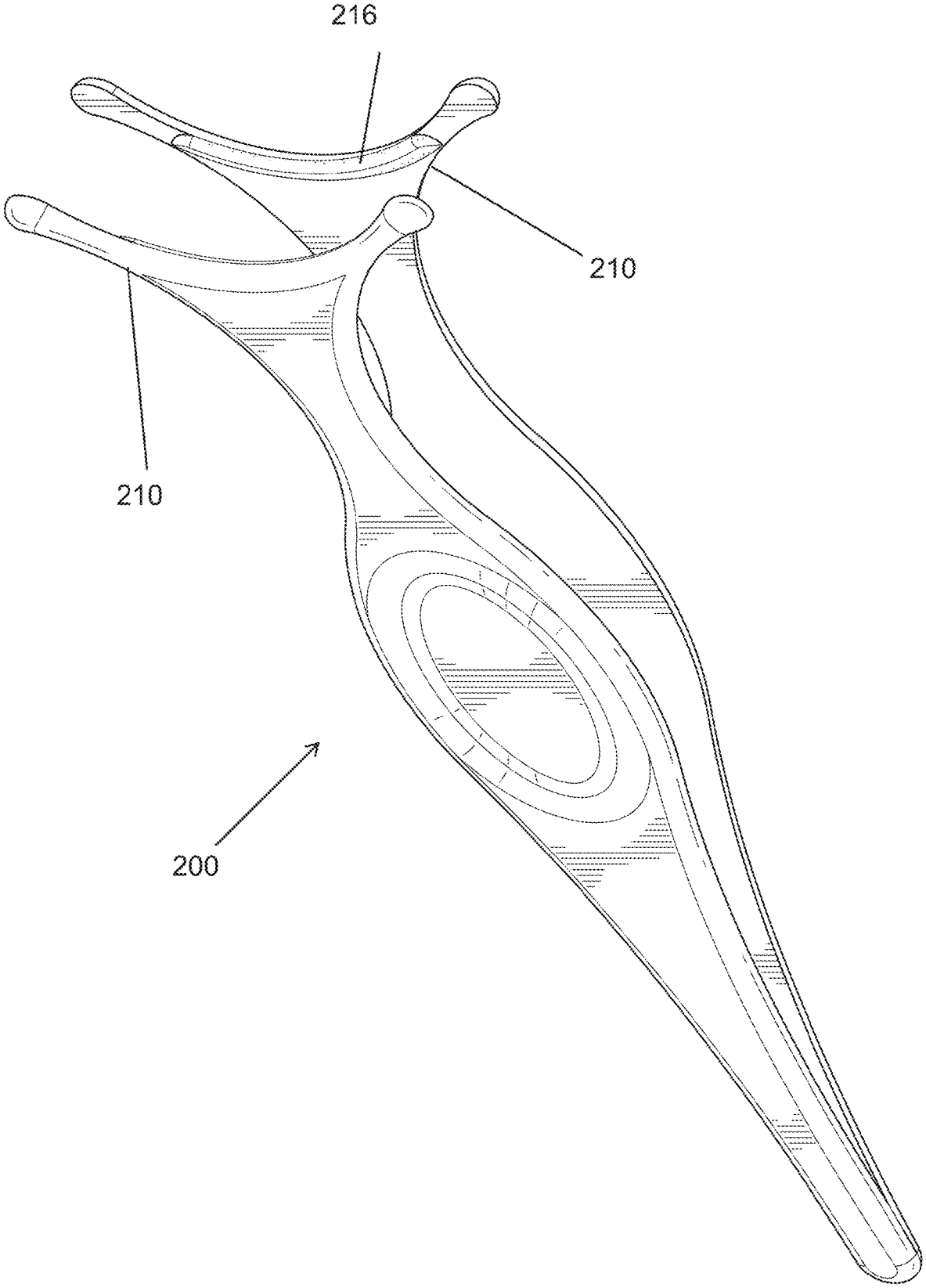

Generally, this disclosure enables applicators for applying eyelash extensions and methods for use and manufacture thereof. In particular, these applicators host male/female tips that can improve application of adhesives to eyelash extensions or natural eyelashes. Regardless of the specific shape of the applicators, the male/female tips aid, enable, or cause spreading of the adhesives (e.g., along male projections, within female depressions) and/or makes the adhesives less user visible (e.g., minimize clumping of adhesives).

FIGS. 1-8 show a plurality of views of an embodiment of an applicator according to this disclosure. In particular, an applicator 100 (e.g., tweezer, tongs) includes a pair of arms 102 having a pair of medial portions 106 and a pair of grasping tips 108. The pair of arms 102 are joined at a common point 104 such that the pair of medial portions 106 are positioned between the common point 104 and the pair of grasping tips 108 and such that the pair of arms 102 define a default position shaped in a V-shape. As such, the pair of arms 102 are in the default position when defining the V-shape via the common point 104. Therefore, the applicator 100 includes the first arm 102 having the first grasping tip 108 that is arcuate and the second arm 102 having the second grasping tip 108 that is arcuate.

Each arm of the pair of arms 102 has an inner side and an outer side such that the inner sides face each other in the default position and such that the pair of arms 102 are symmetrical to each other at the medial portions 106 or at the grasping tips 108. It should be understood that non-symmetrical embodiments are possible.

Each of the medial portions 106 of the pair of medial portions 106 is humped such that a concave shape is defined thereby (e.g., for resting against a user's cheekbone or user's nose bridge). Likewise, each grasping tip 108 of the pair of grasping tips 108 is arcuate such that an arcuate shape is defined thereby. As such, the concave shapes and the arcuate shapes are respectively positionally consecutive and respectively face a same direction respectively lateral to the pair of arms 102. Correspondingly, each medial portion of the pair of medial portions 106 and each grasping tip of the pair of grasping tips 108 consecutively and longitudinally extend such that a valley is defined therebetween. These valleys respectively longitudinally oppose each other in the default position.

Each medial portion of the pair of medial portions 106 has the outer side that has a textured portion 110, in this case parallel grooves and ridges, but can also be non-textured. The outer sides of the medial portions 106 face opposite directions.

The grasping tips 108 include a first grasping tip 108 and a second grasping tip 108. The first grasping tip 108 has a first inner side hosting, including, or defining a male portion 114 (e.g., projection). Although the male portion 114 is D-shaped, the male portion 114 can be shaped differently (e.g., U-shape, C-shape, V-shape, P-shape, B-shape, or other shape). The male portion 114 can be continuous (e.g., single projection, protrusion, or otherwise) or discontinuous (e.g., set of projections that are positionally proximate one another). The second grasping tip 108 has a second inner side hosting, including, or defining a female portion 112 (e.g., depression). Although the female portion 112 is shaped to receive a D-shape, the female portion 112 can be shaped differently for receiving other shapes (e.g., U-shape, C-shape, V-shape, P-shape, B-shape, or other shape). The female portion 112 can be continuous (e.g., single depression) or discontinuous (e.g., set of depressions that are positionally proximate). In general, the male portion 114 and female portion 112 have reciprocal profiles so that when the grasping tips 108 are closed, the portions 114 and 112 mesh with one another, thereby spreading a fluid adhesive disposed on eyelashes so as to be more evenly distributed to cause the eyelash extensions to appear more natural.

The male portion 114 and the female portion 112 are spaced from one another when the first arm 102 and the second arm 102 are at the default or open position in the V-shape. However, the male portion 114 and the female portion 112 mate (i.e., fit together with an elongated protrusion of the male portion 114 extending into an extended protrusion of the female portion 112) when the first arm 102 and the second arm 102 are in a closed or grasping position. The grasping position is formed when the first grasping tip 108 and the second grasping tip 108 are moved closer to each other from the default position by a user squeezing the arms 102 together. For example, in the grasping position, the first arm 102 and the second arm 102 can form an I-shape. Likewise, the first grasping tip 108 and the second grasping tip 108 can be moved away from each other toward the default position by a user reducing pressure to the first grasping tip 108 or to the second grasping tip 108 or to at least one of the medial portions 106, which can be at that respective textured portion 110. As such, the arms 102 can resiliently move or be biased to move between the grasping position and the default position (e.g., from grasping position to the default position).

The applicator 100 can be used to perform a process of applying false eyelashes to natural eyelashes. A user may initially apply an adhesive to a natural lash to which the lash extension is to be applied by using a mascara wand or otherwise. Alternatively, the adhesive may be applied to the lash extension prior to applying the lash extension to the natural lash. The process can include causing a lash extension (or another object) to be resiliently grasped (e.g., by hairs, by base) via clamping between the male portion 114 of the first inner side of the first arcuate grasping tip 108 of the first arm 102 of the applicator 100 and the female portion 112 of the second inner side of the second arcuate tip 108 of the second arm 102 of the applicator 100 while the male portion 114 and the female portion 112 mate and the first inner side faces the second inner side. Further, the method can include causing the lash extension (or another object) to be released or placed onto a natural lash of the user (e.g., upper or lower side of upper or lower natural lash). Therefore, the method can enable a self-application of the lash extension via the applicator 100. In an alternative embodiment, a user may use his or her fingers to apply the lash extensions to the natural lashes with the adhesive applied to the natural lashes and/or lash extensions. As such, since the first arm 102 has a first longitudinally extending non-tip portion (e.g., medial portion 106) and the second arm 102 has a second longitudinally extending non-tip portion (e.g., medial portion 106), then the first longitudinally extending non-tip portion and the second longitudinally extending non-tip portion can be lateral to the natural lash (e.g., to right thereof or to left thereof) when the lash extension is released onto the natural lash (e.g., for adhering, magnetizing, fastening, securing).

After the lash extension(s) are placed onto the natural eyelash and weakly adhered thereto by an adhesive, the user may squeeze the tips 108 with the male portion 114 and female portion 112 on the natural lashes and lash extensions, thereby causing the adhesive to better connect the lash extensions to the natural lashes by more evenly distributing the adhesive as the portions 114 and 112 are pressed together. And, because the male portion 114 and female portion 112 may be non-stick material or coated with a non-stick material, the adhesive may not or minimally stick to the portions 114 and 112.

The adhesive, which can be pressure-sensitive, may be a waterproof (semi-permanent) glue, mascara, or some other co-polymer solution having an adhesive quality. Although latex-based adhesives are generally avoided to avoid irritation of the individual's eyelid (e.g., due to an allergic reaction), adhesives can include various other natural and/or chemical ingredients. Examples of possible adhesives include: Arcrylates/ethylhexyl acrylate copolymer, aqua, propylene glycol, ceteareth-25, hydrogenated castor oil, glycerin, phenoxyethanol, 2-bromo-2-nitropropane-1, 3-diol, methylcholoroisothiazolinone, methylisothiazolinone, methylparaben, and optionally a color agent (e.g., black 2 (C177266)); Polyterpene, styrene/isoprene copolymer, petrolatum, polyisobutene, microcrystalline wax (cera microcristalina, cire microcrystalline), hydrogenated styrene/methyl styrene/indene copolymer, styrene/VA copolymer, and optionally an antioxidant (e.g., butylated hydroxytoluene (BHT)); Chlorine dioxide, p-anisic acid, biotin, *lavandula angustifolio* oil, propylene glycol, water, 2-ethylhexyl acrylate, and optionally a preservative (e.g., benzalkonium chloride); and Acrylate copolymer and water. Note that many other adhesive compositions are possible and, in fact, may be desirable for individuals having certain allergies, desiring certain fixation duration (also referred to as "permanency" of the lash extensions), or other use cases.

Semi-permanent clusters of lash extensions may be applied with a Federal Drug Administration-approved (FDA-approved) adhesive that achieves a strong bond. Such adhesives generally include cyanoacrylate. Different types of cyanoacrylates (e.g., ethyl, methyl, propyl, butyl, and octyl) have been designed for bonding to different surfaces. For example, adhesives made from methyl-2-cyanoacrylateare are designed to bond a smooth surface (e.g., the lash extension) to a porous surface (e.g., the natural eyelash), but not on the skin as it may cause irritation.

The adhesive may be a semi-permanent glue or mascara. The adhesive can include an oil-soluble polymer or a water-soluble polymer that helps to enhance adhesion and substantivity of the lash extension to the natural eyelashes. The adhesive may be a waterproof formulation that allows the set of lash extensions to remain affixed to the natural lashes for longer periods of time (e.g., days, weeks, or months).

Although latex-based adhesives are generally avoided to avoid eyelid irritation (e.g., due to an allergic reaction), adhesives can include various other natural ingredients (e.g., sugar or honey) and/or chemical ingredients. For example, copolymer is often a main ingredient in many adhesive formulations. The adhesive could be a commercially-available adhesive for conventional lash extensions or a specialized composition for use with the set of lash extensions described herein. The adhesive could be clear or colored (e.g., milky white or black to emulate mascara).

The male portion 114 may include one or more protrusions (e.g., one or more protrusions that extend along the inside wall of one of the grasping tips 108), and may be assembled with the first inner side (e.g., fastened, adhered, mated, magnetized, bolted, stapled, nailed, brazed, heat bonded, formed or defined by an inner surface of the grasping tip 108). The female portion 112 may include one or more depressions (e.g., one or more grooves that extend along the inside wall of the other one of the grasping tips 108), and may be assembled with the second inner side (e.g., fastened, adhered, mated, magnetized, bolted, stapled, nailed, brazed, heat bonded, formed or defined by an inner surface of the grasping tip 108). The male portion 114 can be monolithic with the first inner side (e.g., formed from same material). The female portion 112 can be monolithic with the second inner side (e.g., formed from same material).

The male portion 114 or the female portion 112 can be or can avoid being coated with a friction enhancing or reducing coating. For example, a friction enhancing coating can be rubber. Alternatively, the friction reducing coating can be polytetrafluoroethylene (PTFE), silicon, or others. The male portion 114 or the female portion 112 can be treated (e.g., by being powder coated) to improve durability, resistance to scratching, cleanability, resistance to chemicals/solutions, lash extension stickiness, lash extension adhesion, or others. For example, the male portion 114 or the female portion 112 may have a non-stick surface to avoid stickiness or limit the ability to retain adhesive used to apply the lash extensions after squeezing or pinching the tips 108 onto the lashes with the adhesive. Examples of non-stick coatings include PTFE coatings, silicone coatings, or others.

The applicator 100 may be partially or entirely composed of metal (e.g., aluminum, iron, gold, silver, titanium, copper), alloy (e.g., stainless steel, brass), plastic, or some other material (e.g., wood). For example, in some embodiments the applicator 100 may have a smooth powder coating (e.g., for aesthetics and improved cleanability), while in other embodiments the applicator 100 includes a recyclable (i.e., disposable) plastic body that is not intended for significant durations of use (e.g., months or years). For example, in some embodiments plastic may be desirable because it is recyclable and resistant to the adhesives typically applied to the lash extensions before fixation to the natural lashes. For example, the applicator 100 can be composed of metal, plastic, or any other suitable material. Metal alloys (e.g., stainless steel) are typically preferred because they provide greater durability and allow the applicator 100 to have high precision. The term "precision" can refer to the size of objects that can be grasped by the applicator 100. Highly precise grasping tools (e.g., tweezers) can grab very small objects. In order to have high precision, the arms 102 can be precisely aligned and balanced so that an individual can grasp individual artificial lashes. Other materials may also be used to form the applicator 100. For example, the pair of 102 may include of plastic, glass, foam, or other suitable materials. Moreover, the applicator 100 may be formed from a single piece of material rather than a pair of separate fragments. In such embodiments, the single piece of material can be formed into a V-shaped body having opposed arms 102 and the common point 104, i.e., an apex (e.g., via application of heat to central point at which single piece of material is folded).

As shown in FIGS. 1-8, the applicator 100 can be used for applying an artificial lash extension where the applicator 100 has a textured central portion 100 and an arcuate tip 108 that has an internal male 112 or female 114 portion. The applicator 100 has a pair of arms 102 (e.g., metal, plastic) coupled to each other at a common point 104 (e.g., fused, bonded, molded) such that the arms 102 define a V-shape in a default position. Each of the arms 102 has a central portion 106 that is humped and a tip portion 108 that is arcuate. The artificial lash extension can be manufactured manually or automatically (e.g., an industrial machine that feeds or drops or deposits a plurality of artificial lashes onto a surface, applies an electrical charge to the artificial lashes such that the artificial lashes are oriented in a same direction, apply a heating element or hot fluid to common end areas of the artificial lash extensions such that the artificial lash extensions are fused in those to form a cluster of artificial lash extensions is formed).

At least one of the central portions 106 has an external textured portion 110 (e.g., parallel lines, intersecting lines) to help in finger grasping, although at least one of the central portion can be non-textured, such as smooth or otherwise. At least one of the central portions 106 can lack the external textured portion as well. The textured portion 110 can be textured in various ways, such as knurled, hatched, spiked, bumped, or others, whether inward or outward.

At least one of the tip portions 108 can be structured to have an arcuate longitudinal extension that corresponds to an arcuate, longitudinal and outward extension of an external side of an outer sidewall of a case hosting a plurality of artificial lash extensions, as described herein. For example, when both of the tip portions 108 arcuately and longitudinally correspond to the external side of the outer sidewall, then this configuration can enable the tip portions 108 to grasp several of the artificial lash extensions simultaneously from the case. For example, the arcuate longitudinal extension of at least one of the tip portions 108 can structurally correspond or match the curvature of the upper eyelid, which can include an upper waterline or tightline of a user. The tip portions 108 and female/male portions 112/114 may be configured such that when the arms 102 are forced together by The tip portions 108 have opposing inner sides that host female/male portions 112, 114 operative for mating engagement with each other when the tips 108 are moved toward each from the default position via the application of force to the central portions 106 in order to grasp an item, such as an artificial lash extension from a case, via the tip portions 108. The female/male portions 112, 114 may extend along the longitude of the tips 108 in a continuous (e.g., solid line or scattered pattern) or discontinuous manner (e.g., broken line or scattered pattern). As shown, the left arm 102 has a female portion 112 (e.g., U-shape in cross-section) and the right arm 102 has a male portion 114 (e.g., D-shape in cross-section) although this arrangement can be reversed or varied.

The female/male portions 112, 114 can provide a crimping or clamping mechanism, which allows more efficient or impactful or forceful fusion or aid, enable, or cause spreading of the adhesives (e.g., along male projections, within female depressions) so as to make the adhesives less visible (e.g., minimize clumping of adhesives). The crimping or clamping mechanism with the female/male portions 112, 114 may improve fusion of an artificial lash extension with a natural lash by more evenly distributing the adhesive, which may be a relatively soft or fluid adhesive (e.g., ethylhexyl acrylate copolymer) as compared to an adhesive that cures in a hard state (e.g., cyanoacrylates). In an embodiment, a male-to-male portion 114, 114 or female-to-female portion 112, 112 arrangements are possible. Likewise, a male or female portion-to-smooth or flat portion is possible, as well. The female/male portions 112, 114 may be configured to operate as a fusing tool (i.e., a tool to fuse lash extensions to natural lashes) as opposed to a tool configured to shape a lash. The tip portion 108 can be unitary with the central portion 106 or made of same material as the central portion 106 (e.g., metal, alloy, rubber, plastic, etc.). The tip portion 108 can have an inner side that is coated with a friction enhancing or decreasing material (e.g., rubber, plastic, foam, silicon, PTFE, etc.) or the inner side can include a textured portion (e.g., parallel lines, intersecting lines) to help in item grasping, although the inner side can be non-textured, such as smooth or others. The textured portion can be textured in various ways, such as knurled, hatched, spiked, bumped, or otherwise, whether inward or outward.

The tip 108 can be encased in a sock-shaped, tubular, and flexible sheath (e.g., plastic, rubber). When the applicator 100 is used and the arms 102 are pushed inward via the central portions 106 from the default position such that the tips 108 move toward each other to grasp an item, such as an artificial lash extension from a case, the central portions 106 may be configured not to contact each other, thereby defining a gap therebetween. Note that the applicator 100 can be configured to clamp or crimp. For example, the applicator 100 can clamp when the applicator 100 hosts a ratcheting mechanism (e.g., gear and pawl) between the arms 102 that controls inward movement of the arms 102 when the arms are pushed inward via the central portions 106 from the default position such that the tips 108 move toward each other to grasp an item and then remain in that position, which can include the grasping position, if the arms 102 are let go or the application of forces ceases.

FIGS. 9-16 show a plurality of views of an embodiment of an applicator according to this disclosure. In particular, an applicator 200 can be similar in functional operation to the applicator 100 with a different shape. In particular, the applicator 200 has a pair of arms 202, a pair of medial portions 204, a pair of tips 206, a dimpled portion 208, a pair of arcuate portions 210, a female portion 212, a plurality of pairs of bulges 214, a male portion 216. As such, the first grasping tip 206 or the second grasping tip 206 can be respectively transverse or at least partially perpendicular to the first arm 202 and/or the second arm. Further, at least one of the medial portions 204 is dimpled via the dimpled portion 208. Also, the dimpled portion 208 can be textured, as in the applicator 100. Moreover, the first arcuate portion 210 defining a first grasping tip is bulged on both ends thereof and the second arcuate portion 210 defining a second grasping tip may be bulged on both ends.

The applicator 100 can be used to perform a process of applying false eyelashes to natural eyelashes. A user may initially apply an adhesive to a natural lash to which the lash extension is to be applied by using a mascara wand or otherwise. Alternatively, the adhesive may be applied to the lash extension prior to applying the lash extension to the natural lash. The process can include causing a lash extension (or another object) to be resiliently grasped (e.g., by hairs, by base) via clamping between the male portion 216 of the first inner side of the first arcuate portion 210 of the first arm 202 of the applicator 200 and the female portion 212 of the second inner side of the second arcuate portion 210 of the second arm 202 of the applicator 200 while the male portion 216 and the female portion 212 mate and the first inner side faces the second inner side. Further, the method can include causing the lash extension (or another object) to be released or placed onto a natural lash of the user (e.g., upper or lower side of upper or lower natural lash). Therefore, the method can enable a third-party-application of the lash extension via the applicator 200. In an alternative embodiment, a user may use his or her fingers to apply the lash extensions to the natural lashes with the adhesive applied to the natural lashes and/or lash extensions. Since the first arcuate portion 210 is transverse to the first arm 202 and the second arcuate portion 210 is transverse to the second arm 202, then the first arm 202 and the second arm 202 longitudinally extend away from the natural lash when frontal to the natural lash and when the lash extension is released or placed onto the natural lash.

As shown in FIGS. 9-16 the applicator 200 can be used for applying an artificial lash extension where the applicator 200 has a dimpled central portion 208 and a pair of "snail-head" shaped arcuate portions 210 that have female or male portions 212, 216 disposed on inside surfaces of the second arcuate portion 210. The applicator 200 has a pair of arms 200 (e.g., metal, plastic) coupled to each other at a common point (e.g., fused, bonded, molded) such that the arms define a V-shape in a default position. Each of the arms 202 has the central portion 204 that is inwardly dimpled at the dimpled portion 208 so as to help a user operate the applicator 200 and a tip portion 210 that is arcuate (e.g., C-shaped, V-shaped, U-shaped) and bulged on opposing arcuate ends 214. It should be understood that the bulging at the ends 214 is illustrative, and alternative embodiments may not include the bulged ends 214. The dimpled portion 208 can be textured (e.g., parallel lines, intersecting lines) to help in finger grasping, although the dimpled portion 208 can be non-textured, such as smooth or others. The dimpled portion 208 can be textured in various ways, such as knurled, hatched, spiked, bumped, or others, whether inward or outward.

At least one of the tip portions 210 can be structured to have an arcuate longitudinal extension that corresponds to an arcuate, longitudinal and outward extension of an external side of an outer sidewall of a case hosting a plurality of artificial lash extensions, as described herein. For example, when both of the tip portions 210 arcuately and longitudinally correspond to the external side of the outer sidewall, then this configuration can enable the tip portions 210 to grasp several of the artificial lash extensions simultaneously from the case. For example, the arcuate longitudinal extension of at least one of the tip portions 210 can structurally correspond or match the curvature of the upper eyelid, which can include the upper waterline or tightline of the user on which lash extensions are being placed.

The arcuate portions 210 have opposing inner sides that host female/male portions 212, 216 operative for mating engagement with each other when the arcuate portions 210 are moved toward each from the default position via the applications of force to the central portions 204 in order to grasp an item, such as an artificial lash extension from a case, via the arcuate portions 210. The male/female portions 212, 216 can be extending along the longitude of the arcuate portions 210 in a continuous (e.g., solid line or scattered pattern) or discontinuous manner (e.g., broken line or scattered pattern). As shown, the left arm 202 has a female portion 212 (e.g., U-shape in cross-section) and the right arm 202 has a male portion 216 (e.g., D-shape in cross-section) although this arrangement can be reversed. The male/female portions 212, 216 provide a crimping or clamping mechanism, which allows more efficient or impactful or forceful fusion or aid, enable, or cause spreading of the adhesives (e.g., along male projections and within female depressions or indentations) so as to make the adhesives less visible (e.g., minimize clumping of adhesives). The crimping or clamping mechanism with the female/male portions 212, 216 may improve fusion of an artificial lash extension with a natural lash by more evenly distributing the adhesive, which may be a relatively soft or fluid adhesive (e.g., ethylhexyl acrylate copolymer) as compared to an adhesive that cures in a hard state (e.g., cyanoacrylates). In an embodiment, a male-to-male portion 216 or female-to-female portion 212 arrangements are possible. Likewise, a male or female portion-to-smooth or flat portion is possible, as well. The female/male portions 212, 216 may be configured to operate as a fusing tool (i.e., a tool to fuse a lash extension formed of multiple fibers to natural lashes) as opposed to a tool configured to shape a lash. The arcuate portion 210 can be unitary with the central portion 204 or made of same material as the central portion 204 (e.g., metal, rubber, plastic, etc.). The arcuate portion 210 can have an inner side that is coated with a friction enhancing or reducing material (e.g., rubber, plastic, foam, silicon, PTFE, etc.) or the inner side can include a textured portion (e.g., parallel lines, intersecting lines) to help in item grasping, although the inner side can be non-textured, such as smooth or others. The textured portion can be textured in various ways, such as knurled, hatched, spiked, bumped, or others, whether inward or outward.

Figure 17B:
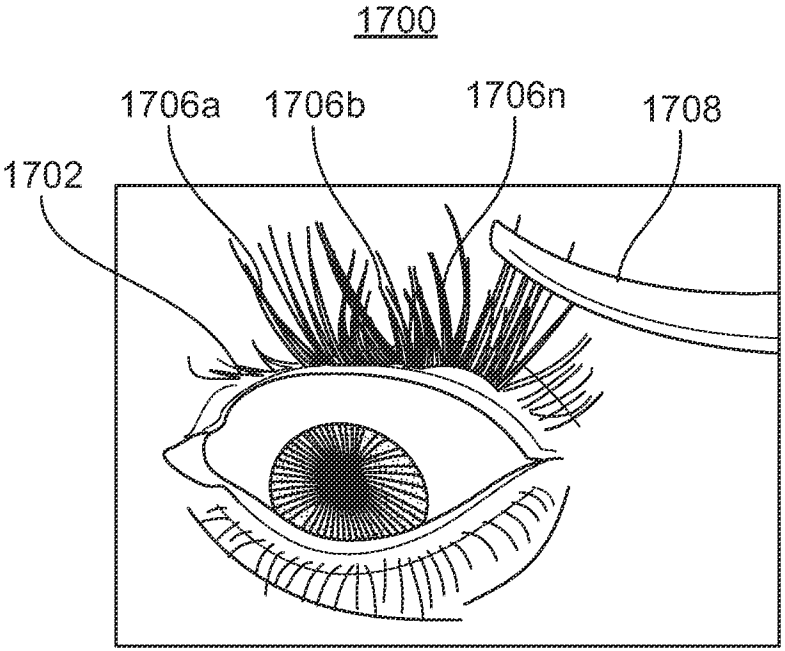
FIGS. 17A-17C show a sequence of respectively applying an adhesive to natural lashes, positioning lash extensions on the natural lashes, and using an applicator to fuse the lash extensions to the natural lashes by evenly distributing the adhesive with male/female features on the tips.
Figure 17A:
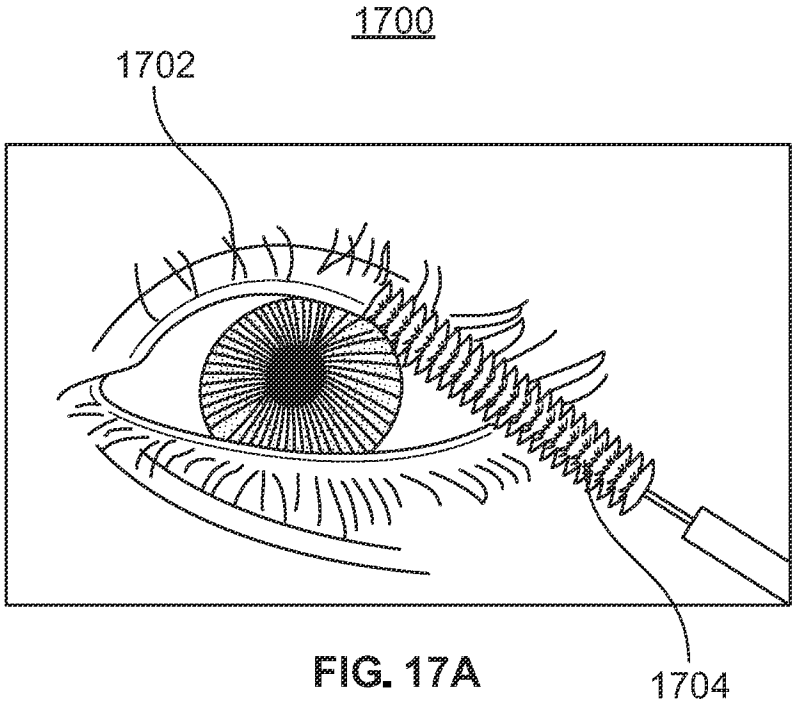
Figure 17C:
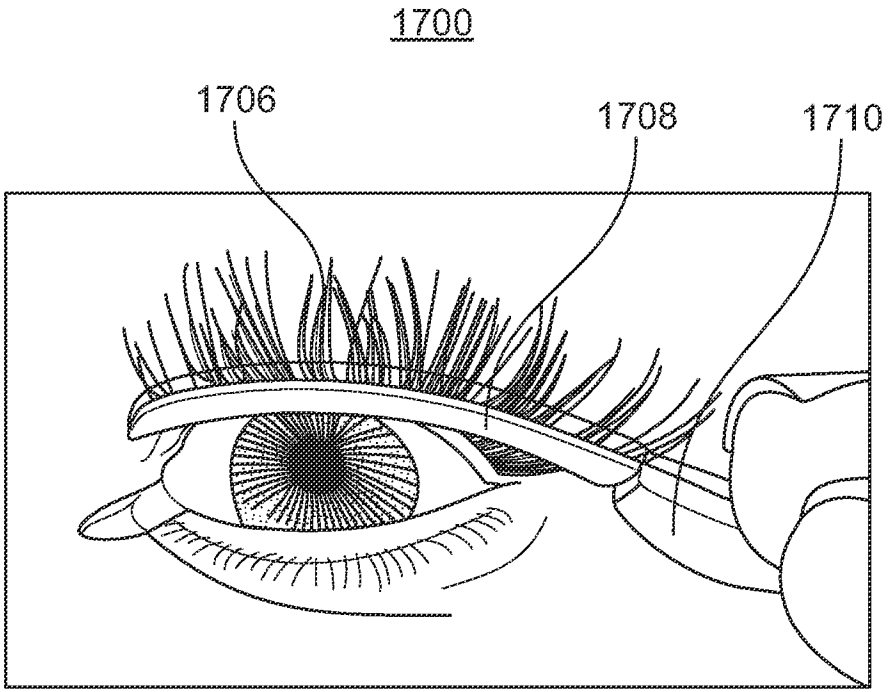

FIGS. 17A-17C show a sequence of respectively applying an adhesive to natural lashes, positioning lash extensions on the natural lashes, and using an applicator to fuse the lash extensions to the natural lashes by evenly distributing the adhesive with male/female features on the tips. The process may start in FIG. 17A, where an eye 1700 including natural eyelashes 1702 may have an adhesive applicator 1704 apply a flexible adhesive to the natural lashes 1702 to the lower side of the natural lashes. The adhesive applicator 1704 may be a conventional mascara wand or a wand that is specifically designed to apply the flexible adhesive. Although the application of the adhesive by the adhesive applicator 1704 may be relatively even across the natural lashes 1702, the adhesive may have some level of inconsistency (e.g., globs or more adhesive in some areas and less in other areas of the natural lashes). As a result of the adhesive being soft and fluid, a user may be able to spread or redistribute the adhesive later on (see FIG. 17C).

As shown in FIG. 17B, after the adhesive has been applied to the natural eyelashes 1702 (or alternatively or additionally to the upper side of the lash extensions) in FIG. 17A, lash extensions 1706*a*-1706*n* (collectively 1706) may be placed on a lower side of the natural eyelashes 1702, such that an upper side of the lash extensions 1706 is tacked or otherwise attached to the natural eyelashes 1702 by contacting the lash extensions 1706 to the adhesive on the natural lashes 1702 (or the adhesive on the lash extensions 1706 to the natural lashes 1702). Because the lash extensions 1706 in this case are light (e.g., heat-fused fibers), the tackiness of the adhesive may be sufficient to hold the lash extensions 1706 in place. In placing the lash extensions 1706, a user may hold one more set of the lash extensions 1706 by a tip 1708 including a first and second tip extending from first and second arms of an applicator 1710, as previously provided. The tip 1708 may have protrusions and recessions disposed on respective inside surfaces of the tip 1708.

As shown in FIG. 17C, the user may rotate the applicator 1710, such that a curvature of the tip 1708, which in this case has an arcuate shape, may extend along the natural eyelashes 1702 and lash extensions 1706, where one of the tips may be on one side of the natural lashes 1702 and the other one of the tips may be on the other side of the natural lashes 1702. As the user applies force to the arms of the applicator 1710 to cause the first tip and second tip to simultaneously squeeze or apply force to the adhesive, natural lashes 1702, and lash extensions 1706 so as to cause the adhesive to be distributed along a channel formed by the depression of the female portion of one of the tips as the protrusion of the male portion of the other one of the tips extends into the depression. That is, the soft adhesive will be more evenly distributed along the natural lashes 1702 and lash extensions 1706, thereby fusing the natural lashes 1702 and lash extensions 1706 together in a more seamless way. The squeezing of the tips may also cause the lash extensions 1706 to be better matted to the natural lashes 1702.

Figure 18B:
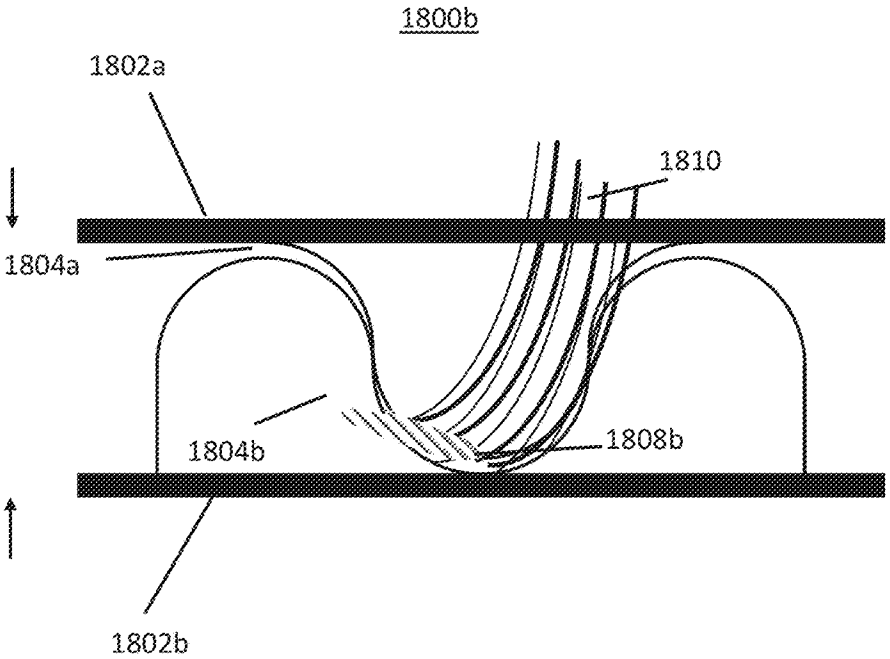
FIGS. 18A-18B show a sequence of using tips with male/female features of an applicator to fuse natural lashes and lash extensions.
Figure 18A:
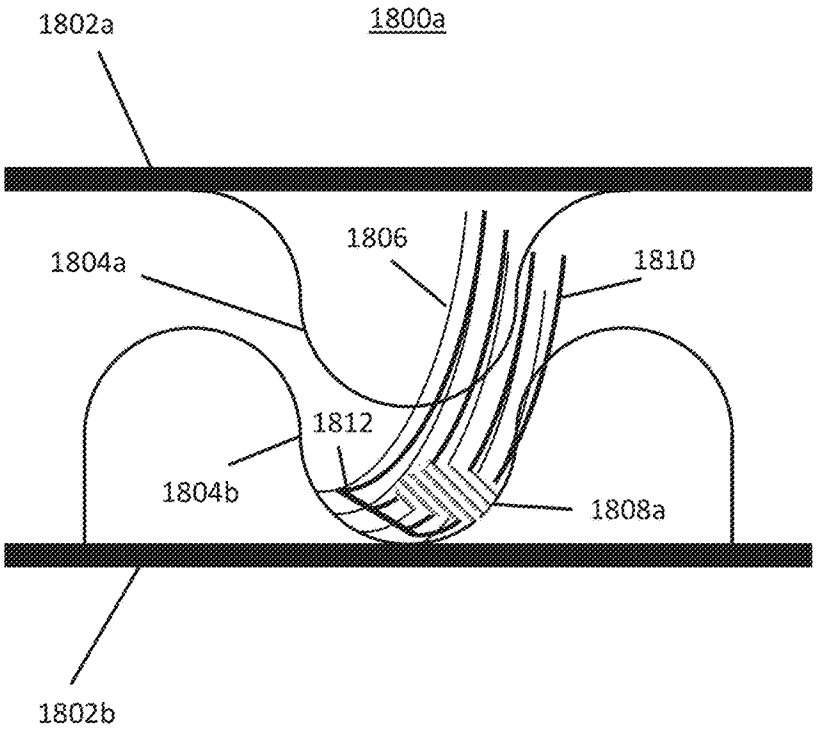

FIGS. 18A-18B show a sequence of using tips with male/female features of an applicator to fuse natural lashes and lash extensions.

As shown in FIG. 18B, as the protrusion 1804*a* of the male portion is pressed into the depression 1804*b* of the female portion with the natural lashes 1806 and lash extension 1810 being held by the adhesive, the adhesive region 1808*a* may be compressed and traverse within a channel formed between the protrusion 1804*a* and depression 1804*b*, thereby causing the adhesive region 1808*a* to be redistributed to become adhesive region 1808*b*. The adhesive region 1808*b* may result in a more evenly distributed adhesion region, thereby causing a fusion between the natural lashes 1806 and lash extension 1810 to be stronger.

Another embodiment of a process for applying lash extensions to natural lashes may include causing an adhesive holding the lash extension formed of multiple fibers and natural lashes together to be simultaneously grasped between at least one protrusion defining a male portion of a first inner side of a first tip of a first arm disposed on an applicator and at least one depression that defines a female portion disposed on a second inner side of a second tip of a second arm of the applicator, thereby causing the adhesive to be spread along a region between the male and female portions.

The process may further include comprising causing the male and female portions to separate after being simultaneously grasped, thereby causing the lash extension to be adhered to the natural lashes with the adhesive more evenly distributed across the lash extension and natural lash. In simultaneously grasping, the first and second tips may be aligned to extend longitudinally across the natural lashes of an eye prior to simultaneously grasping.

One embodiment of a method for redistributing an adhesive applied to a lash extension formed of multiple fibers and natural lashes may include causing the adhesive disposed on the natural lashes and lash extension to extend along a surface of an elongated depression disposed on a first tip of a first arm of an applicator and a surface of an elongated protrusion disposed on a second tip of a second arm when the elongated protrusion is vertically extended into the elongated depression with the adhesive, natural lashes, and lash extension being positioned between the elongated depression and elongated protrusion. The process may further include causing the adhesive to have reduced adhesion to either of the surfaces of the elongated depression or elongated protrusion One embodiment of a method of manufacturing an applicator may include forming a first arm including a first grasping tip having a first inner side including at least one protrusion that defines a male portion, and forming a second arm including a second grasping tip having a second inner side including at least one depression that defines a female portion. The first and second arms may be connected at a first end opposite a second end at which the first and second grasping tips are located, and with the first inner side facing the second inner side. The male portion and the female portion may be aligned with one another so that when the first arm and the second arm are in an open position, the male and female portions are separated from one another, and when the first arm and second arm are in a closed position, the male portion and the female portion mate with one another.

Forming the first arm may include applying the male portion to the first inner side, and forming the second arm may include applying the female portion to the second inner side. Forming the first arm may include forming the male portion on the first inner side of the first grasping tip, and forming the second arm may include forming the female portion on the second inner side of the second grasping tip.

It should understood that the applicators be embodied in many different forms and should not be construed as necessarily being limited to the embodiments disclosed herein. Rather, the embodiments provided herein are provided so that this disclosure is thorough and complete, and fully conveys various concepts of this disclosure to skilled artisans.

Various terminology used herein can imply direct or indirect, full or partial, temporary or permanent, action or inaction. For example, when an element is referred to as being "on," "connected" or "coupled" to another element, then the element can be directly on, connected or coupled to the other element and/or intervening elements can be present, including indirect and/or direct variants. In contrast, when an element is referred to as being "directly connected" or "directly coupled" to another element, there are no intervening elements present.

As used herein, a term "or" is intended to mean an inclusive "or" rather than an exclusive "or." That is, unless specified otherwise, or clear from context, "X employs A or B" is intended to mean any of the natural inclusive permutations. That is, if X employs A; X employs B; or X employs both A and B, then "X employs A or B" is satisfied under any of the embodiments.

Although the terms first, second, etc. can be used herein to describe various elements, components, regions, layers and/or sections, these elements, components, regions, layers and/or sections should not necessarily be limited by such terms. These terms are used to distinguish one element, component, region, layer or section from another element, component, region, layer or section. Thus, a first element, component, region, layer, or section discussed below could be termed a second element, component, region, layer, or section without departing from the teachings of the present disclosure.

Furthermore, relative terms such as "below," "lower," "above," and "upper" can be used herein to describe one element's relationship to another element as illustrated in the accompanying drawings. Such relative terms are intended to encompass different orientations of illustrated technologies in addition to the orientation depicted in the accompanying drawings. For example, if a device in the accompanying drawings were turned over, then the elements described as being on the "lower" side of other elements would then be oriented on "upper" sides of the other elements. Similarly, if the device in one of the figures were turned over, elements described as "below" or "beneath" other elements would then be oriented "above" the other elements. Therefore, the example terms "below" and "lower" can encompass both an orientation of above and below.

The terminology used herein is for describing particular example embodiments and is not intended to be necessarily limiting of the present disclosure. As used herein, the singular forms "a," "an" and "the" are intended to include the plural forms as well, unless the context clearly indicates otherwise. Also, as used herein, the term "a" and/or "an" shall mean "one or more," even though the phrase "one or more" is also used herein. The terms "comprises," "includes" and/or "comprising," "including" when used in this specification, specify the presence of stated features, integers, steps, operations, elements, and/or components, but do not preclude the presence and/or addition of one or more other features, integers, steps, operations, elements, components, and/or groups thereof. Furthermore, when the present disclosure states herein that something is "based on" something else, then such statement refers to a basis which may be based on one or more other things as well. In other words, unless expressly indicated otherwise, as used herein "based on" inclusively means "based at least in part on" or "based at least partially on."

Features described with respect to certain example embodiments may be combined and sub-combined in and/or with various other example embodiments. Also, different aspects and/or elements of example embodiments, as disclosed herein, may be combined and sub-combined in a similar manner as well. Further, some example embodiments, whether individually and/or collectively, may be components of a larger system, wherein other procedures may take precedence over and/or otherwise modify their application. Additionally, a number of steps may be required before, after, and/or concurrently with example embodiments, as disclosed herein. Note that any and/or all methods and/or processes, at least as disclosed herein, can be at least partially performed via at least one entity in any manner.

Example embodiments of the present disclosure are described herein with reference to illustrations of idealized embodiments (and intermediate structures) of the present disclosure. As such, variations from the shapes of the illustrations as a result, for example, of manufacturing techniques and/or tolerances, are to be expected. Thus, the example embodiments of the present disclosure should not be construed as necessarily limited to the particular shapes of regions illustrated herein, but are to include deviations in shapes that result, for example, from manufacturing.

Any and/or all elements, as disclosed herein, can be formed from a same, structurally continuous piece, such as being unitary, and/or be separately manufactured and/or connected, such as being an assembly and/or modules. Any and/or all elements, as disclosed herein, can be manufactured via any manufacturing processes, whether additive manufacturing, subtractive manufacturing, and/or other any other types of manufacturing. For example, some manufacturing processes include three dimensional (3D) printing, laser cutting, computer numerical control routing, milling, pressing, stamping, vacuum forming, hydroforming, injection molding, lithography, and so forth.

Any and/or all elements, as disclosed herein, can be and/or include, whether partially and/or fully, a solid, including a metal, a mineral, a gemstone, an amorphous material, a ceramic, a glass ceramic, an organic solid, such as wood and/or a polymer, such as rubber, a composite material, a semiconductor, a nanomaterial, a biomaterial and/or any combinations thereof. Any and/or all elements, as disclosed herein, can be and/or include, whether partially and/or fully, a coating, including an informational coating, such as ink, an adhesive coating, a melt-adhesive coating, such as vacuum seal and/or heat seal, a release coating, such as tape liner, a low surface energy coating, an optical coating, such as for tint, color, hue, saturation, tone, shade, transparency, translucency, opaqueness, luminescence, reflection, phosphorescence, anti-reflection and/or holography, a photo-sensitive coating, an electronic and/or thermal property coating, such as for passivity, insulation, resistance or conduction, a magnetic coating, a water-resistant and/or waterproof coating, a scent coating and/or any combinations thereof. Any and/or all elements, as disclosed herein, can be rigid, flexible, and/or any other combinations thereof. Any and/or all elements, as disclosed herein, can be identical to and/or different from each other in material, shape, size, color and/or any measurable dimension, such as length, width, height, depth, area, orientation, perimeter, volume, breadth, density, temperature, resistance, and so forth.

Unless otherwise defined, all terms (including technical and scientific terms) used herein have the same meaning as commonly understood by one of ordinary skill in the art to which this disclosure belongs. The terms, such as those defined in commonly used dictionaries, should be interpreted as having a meaning that is consistent with their meaning in the context of the relevant art and should not be interpreted in an idealized and/or overly formal sense unless expressly so defined herein.

As used herein, the term "about" and/or "substantially" refers to a +/−10% variation from the nominal value/term. Such variation is always included in any given value/term provided herein, whether or not such variation is specifically referred thereto.

If any disclosures are incorporated herein by reference and such disclosures conflict in part and/or in whole with the present disclosure, then to the extent of conflict, and/or broader disclosure, and/or broader definition of terms, the present disclosure controls. If such disclosures conflict in part and/or in whole with one another, then to the extent of conflict, the later-dated disclosure controls.

Although preferred embodiments have been depicted and described in detail herein, skilled artisans can make various modifications, additions, substitutions and the like can be made without departing from this disclosure, and these are, therefore, considered to be within scope of this disclosure, as claimed.

What is claimed is:

1. An applicator for an artificial lash extension comprising:

a pair of opposing arms comprising a first arm and a second arm, wherein the first arm and the second arm are joined at proximal ends to form a hinge, each of the first and second arms comprising:

a first side opposite a second side, and an interior surface opposite an exterior surface, wherein the interior surface and the exterior surface extend between the first side and the second side;

a medial section extending distally from the proximal end; and a grasping section extending distally from the medial section, the grasping section comprising a first end area that forms a tip, a second end area, a concave curvature disposed between the first end area and the second end area and along at least a part of the second side corresponding to the grasping section, and a convex curvature disposed between the first end area and the second end area and along at least a part of the first side corresponding to the grasping section, wherein the concave curvature is positioned opposite the convex curvature, and wherein the medial section joins to the grasping section at a part of the grasping section that is closer to the second end area than the first end area, wherein a portion of the interior surface corresponding to the grasping section of the first arm comprises (i) a first support that is substantially flat and protrudes from the interior surface, and (ii) a male portion defined by a protrusion disposed on the first support and spaced apart from the first and second sides of the first arm such that portions of the first support are disposed on first and second sides of the protrusion, wherein the first support and the protrusion extend between the first end area and the second end area and have an arcuate contour corresponding to the concave curvature and the convex curvature of the grasping section; and wherein a portion of the interior surface corresponding to the grasping section of the second arm comprises (i) a second support that is substantially flat and that protrudes from the interior surface and (ii) a female portion defined by at least one depression disposed within the second support, wherein the male portion and the female portion have reciprocal profiles designed to crimp natural lashes and the artificial lash extension that are disposed therebetween.

2. The applicator of claim 1, wherein the male portion is fastened to the first arm, and the female portion is fastened to the second arm.

3. The applicator of claim 1, wherein the male portion is monolithic with the portion of the interior surface corresponding to the grasping section of the first arm, and wherein the female portion is monolithic with the portion of the interior surface corresponding to the grasping section of the second arm.

4. The applicator of claim 1, wherein the male portion and the female portion are coated with a friction reducing coating.

5. The applicator of claim 1, wherein a portion of the exterior surface corresponding to the medial section of each arm comprises a textured portion.

6. The applicator of claim 1, wherein a first valley is defined at an intersection between the grasping section of the first arm and the medial section of the first arm, and wherein a second valley is defined at an intersection between the grasping section of the second arm and the medial section of the second arm.

7. The applicator of claim 1, wherein the male portion comprises a single continuous protrusion, and wherein the female portion comprises a single continuous depression.

8. The applicator of claim 1, wherein the applicator is configured to transition from an open position to a closed position, in the open position the male portion and the female portion are separated from one another, and in the closed position the male portion and the female portion mate with one another, wherein the open position of the applicator is a default position, and wherein an application of pressure to the exterior surface of each arm of the applicator transitions the applicator from the open position to the closed position.

9. The applicator of claim 8, wherein the male portion and the female portion have the reciprocal profiles that mate with one another in the closed position.

10. The applicator of claim 8, wherein in the closed position the male portion extends at least in part into the female portion.

11. The applicator of claim 5, wherein the textured portion of each arm comprises grooves and ridges.

12. The applicator of claim 1, wherein the male portion and the female portion are designed to mate to grasp hairs of the artificial lash extension.

13. The applicator of claim 12, wherein the male portion and the female portion of the applicator are designed to mate with one another to bond the artificial lash extension to a lower side of natural lashes.

14. The applicator of claim 1, comprising at least one of a metal or metal alloy.

15. The applicator of claim 1, wherein an apex of the concave curvature is orientated distally from the second end area and orientated proximally from the first end area such the concave curvature is downwardly facing.

16. The applicator of claim 1, wherein the first end area of the grasping section comprises a single terminal distal end.

* * * * *